US005923926A

United States Patent [19]

Isobe et al.

[11] Patent Number: 5,923,926

[45] Date of Patent: Jul. 13, 1999

[54] DEVELOPING DEVICE AND ELECTROPHOTOGRAPHIC IMAGE FORMING APPARATUS

[75] Inventors: Hironobu Isobe; Nobuharu Hoshi, both of Numazu, Japan

[73] Assignee: Canon Kabushiki Kaisha, Tokyo, Japan

[21] Appl. No.: 08/939,482

[22] Filed: Sep. 29, 1997

[30] Foreign Application Priority Data

Sep. 30, 1996 [JP] Japan ..... 8-258877
Sep. 26, 1997 [JP] Japan ..... 9-261738

[51] Int. Cl.[6] ..... G03G 15/00; G03G 15/06

[52] U.S. Cl. ..... 399/119; 399/90

[58] Field of Search ..... 399/90, 106, 111, 399/112, 114, 119, 125, 126

[56] References Cited

U.S. PATENT DOCUMENTS

| | | | |
|---|---|---|---|
| 4,203,386 | 5/1980 | Blochl et al. | 399/119 |
| 4,460,267 | 7/1984 | Ogawa | 399/119 |
| 4,500,195 | 2/1985 | Hosono | 399/111 X |
| 4,707,108 | 11/1987 | Ohno | 399/227 |
| 4,803,521 | 2/1989 | Honda | 399/111 X |
| 5,019,867 | 5/1991 | Yamakawa et al. | 399/119 |
| 5,040,031 | 8/1991 | Hayashi | 395/114 |
| 5,206,619 | 4/1993 | Kita | 399/111 |
| 5,235,383 | 8/1993 | Tada et al. | 399/112 |
| 5,283,619 | 2/1994 | Nomura et al. | 399/90 |
| 5,771,426 | 6/1998 | Oka et al. | 399/119 |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

A developing cartridge for developing a latent image formed on the photosensitive member, which is detachably mountable to a main assembly of an electrophotographic image forming apparatus, the developing cartridge includes a developing member for developing a latent image formed on the photosensitive member; a toner accommodating portion for accommodating toner to be used for developing a latent image formed on the photosensitive member by the developing member; a driving force receiving portion for receiving, from the main assembly, driving force for rotating the developing member when the developing cartridge is mounted to the main assembly, the driving force receiving portion being provided at a leading side of the developing cartridge when the developing cartridge is mounted to the main assembly in a longitudinal direction of the developing member; an exposed developing bias contact, provided at the leading side, for receiving from the main assembly a developing bias to be supplied to the developing member when the developing cartridge is mounted to the main assembly; wherein the driving force receiving portion is disposed inside the developing bias contact in the longitudinal direction of the developing member.

20 Claims, 17 Drawing Sheets

DEVELOPING DEVICE AND ELECTROPHOTOGRAPHIC IMAGE FORMING APPARATUS

FIELD OF THE INVENTION AND RELATED ART

The present invention relates to a developing device usable with an electrophotographic image forming apparatus such as an electrophotographic copying machine, printer or the like, and an electrophotographic image forming apparatus using the same.

The electrophotographic image forming apparatus means an apparatus which forms an image on a recording material using an electrophotographic image forming process. It includes for example an electrophotographic copying machine, an electrophotographic printer (LED printer, laser beam printer), an electrophotographic printer type facsimile machine and an electrophotographic printer type word processor.

Recently, demand for color electrophotographic image forming apparatus capable of forming color images, is increasing.

On the other hand, in a color electrophotographic image forming apparatus compatible with future network, high speed and high volume monochromatic image printing is desired as well as the color printing.

In a known color developing device, all of four color developing devices 105M, 105C 105Y, 105K are carried on a turret (for example, U.S. Pat. No. 4,707,108, or U.S. Pat. No. 5,040,031). Such a structure is very effective in color image formation. The present invention is directed to a further development.

SUMMARY OF THE INVENTION

Accordingly, it is a principal object of the present invention to provide a developing cartridge and an electrophotographic image forming apparatus wherein driving force can be assuredly transmitted from a main assembly of an electrophotographic image forming apparatus to the developing cartridge. It is another object of the present invention to provide a developing cartridge and an electrophotographic image forming apparatus wherein when the developing cartridge is mounted to a main assembly of the electrophotographic image forming apparatus, driving force can be transmitted from a driving force at the positioning portion relative to the main assembly.

It is a further object of the present invention to provide a developing cartridge and an electrophotographic image forming apparatus wherein transmission of driving force from a main assembly of an electrophotographic image forming apparatus to a developing cartridge is effected by a coupling so that rotation non-uniformity of the developing member can be reduced.

According to an aspect of the present invention, there is provided a developing cartridge for developing a latent image formed on the photosensitive member, which is detachably mountable to a main assembly of an electrophotographic image forming apparatus, the developing cartridge comprising: a developing member for developing a latent image formed on the photosensitive member; a toner accommodating portion for accommodating toner to be used for developing a latent image formed on the photosensitive member by the developing member; a driving force receiving portion for receiving, from the main assembly, driving force for rotating the developing member when the developing cartridge is mounted to the main assembly, the driving force receiving portion being provided at a leading side of the developing cartridge when the developing cartridge is mounted to the main assembly in a longitudinal direction of the developing member; an exposed developing bias contact, provided at the leading side, for receiving from the main assembly a developing bias to be supplied to the developing member when the developing cartridge is mounted to the main assembly; wherein the driving force receiving portion is disposed inside the developing bias contact in the longitudinal direction of the developing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the embodiments of the present invention will be described. First, the description will be made as to a structure of a color electrophotographic image forming apparatus, and then as to a structure of a black developing device used therewith.

(General arrangement of color electrophotographic image forming apparatus)

Figure 1:
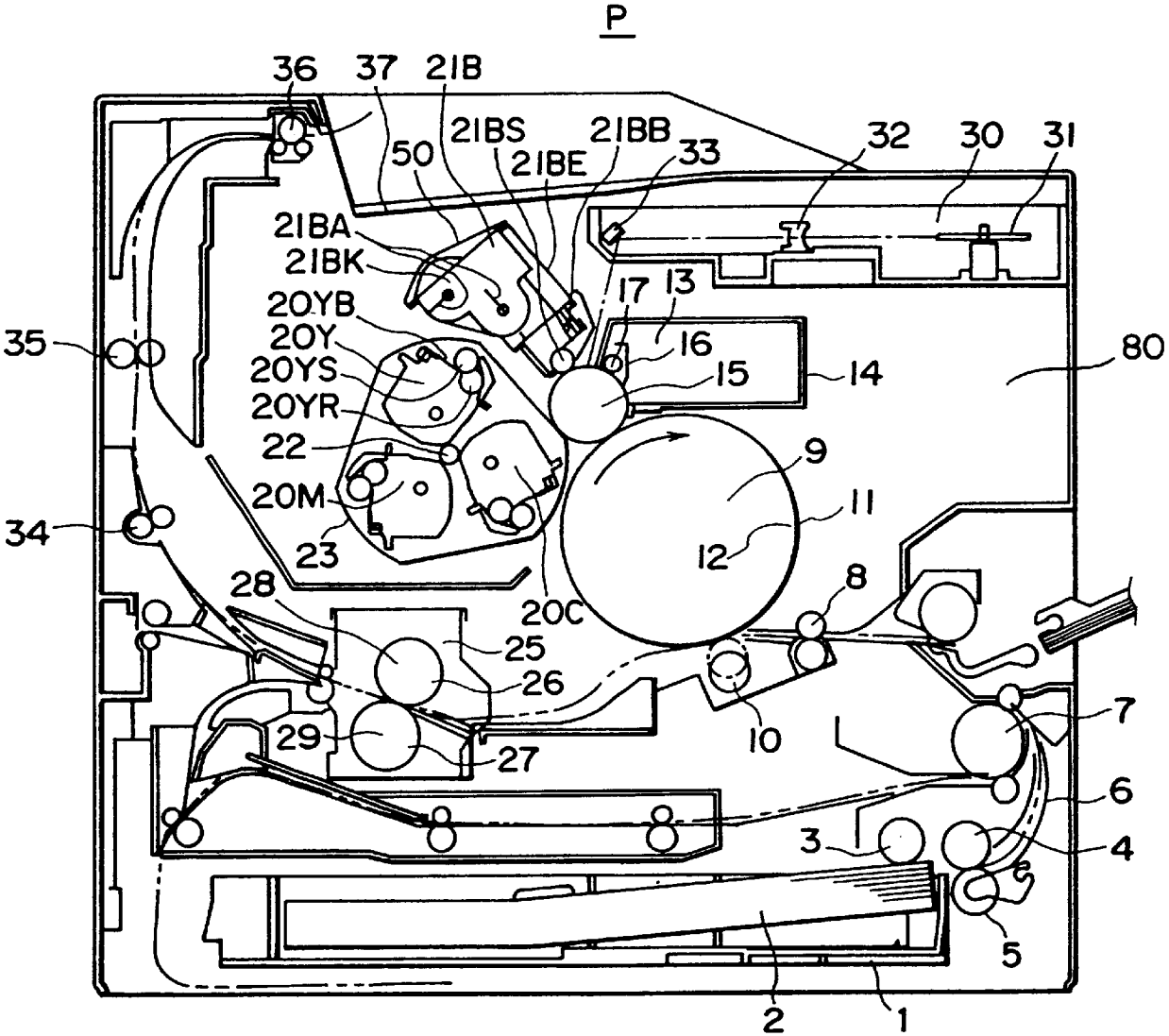
FIG. 1 is an illustration of an entirety of a color laser printer according to an embodiment of the present invention.
Figure 2:
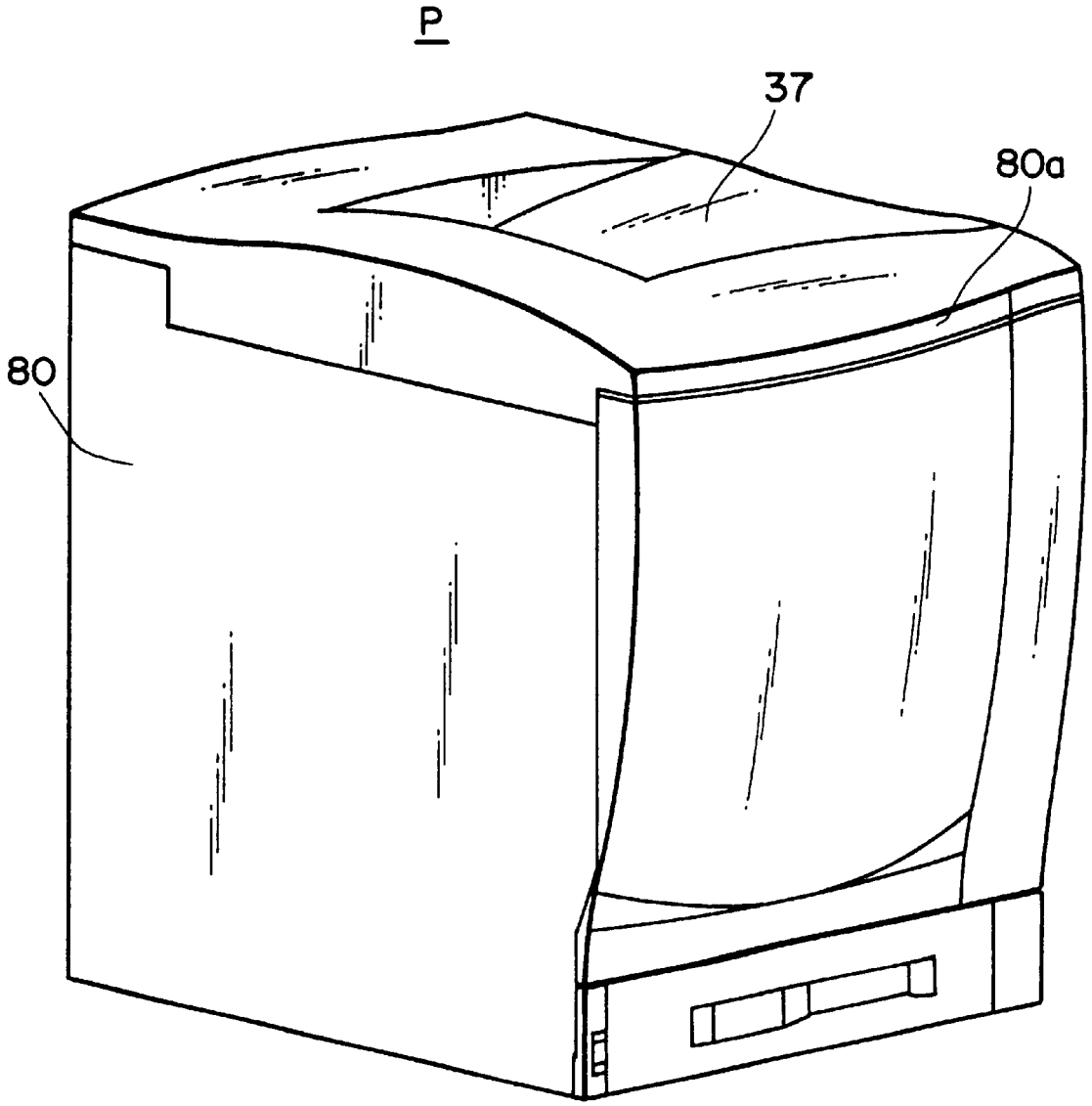
FIG. 2 shows an outer appearance of a color laser printer.

FIG. 1 shows a general arrangement of a color laser printer as a color electrophotographic image forming apparatus according to an embodiment of the present invention, and FIG. 2 is an outer appearance thereof.

The color laser printer P of this embodiment comprises an electrophotographic photosensitive member in the form of a drum (photosensitive drum) 15 which rotates at a constant speed, a developing device 21B (for development with black color toner), three color development devices (yellow developing device 20Y for development with yellow color toner, magenta developing device 20M for development with magenta color toner, and a cyan developing device 20C for development with cyan color toner) detachably mountable to a rotatable or revolvable turret.

Below the photosensitive drum 15, there is provided an intermediary transfer member 9 for carrying a superposedly transferred color image and for transferring the image onto a recording material 2 fed from a feeding portion.

The recording material 2 onto which the color image has been transferred, is fed to a fixing portion 25 to fix the color image on the recording material 2, and then the recording material 2 is discharged to a discharging portion 37 at the top of the apparatus by discharging rollers 34, 35, 36.

The rotatable or revolvable color development devices and the fixed black developing device are detachably mountable relative to the main assembly of the printer, independently from each other.

The description will be made as to various parts of the image forming apparatus P.

(Drum unit)

A drum unit 13 integrally contains the photosensitive drum 15 and a container 14 of a cleaning device functioning as a holder for the drum 15. The drum unit 13 is detachably mountable relative to the main assembly of the printer, and can be easily exchangeable when the lifetime of the photosensitive drum 15 is reached.

The photosensitive drum 15 of this embodiment comprises an aluminum cylinder having a diameter of 62 mm approx. and an organic photoconductive layer applied to the outside of the aluminum cylinder, and is rotatably supported on the container 14 of the cleaning device which functions also as a housing for the photosensitive drum 15.

A cleaner blade 16 and a primary charging means 17 are contacted to the outer peripheral surface of the photosensitive drum 15. The photosensitive drum 15 receives driving force transmitted from a driving motor (unshown) at one longitudinal end, and is rotated in the counterclockwise direction in accordance with an image forming operation.

(Charging means)

The charging means 17 is a contact charging type charger. An electroconductive roller is contacted to a photosensitive drum 15, and the surface of the photosensitive drum 15 is uniformly charged by application of a voltage to the electroconductive roller.

(Exposing means)

The exposure of the photosensitive drum 15 is effected by a scanner 30. More particularly, an image signal is supplied to a laser diode, and the laser diode projects a beam onto a polygonal mirror 31 at a timing corresponding the image signal. The polygonal mirror 31 rotates at a high speed by a scanner motor; the beam reflected by the polygonal mirror 31 is selectively projected onto the surface of the photosensitive drum 15 through an imaging lens 32 and a reflection mirror 33, so that charge latent image is formed on the photosensitive drum 15.

(Developing means)

The developing means includes three rotary developing devices 20Y, 20M, 20C for development in yellow, magenta and cyan colors, and one black developing device 21B for development in black color to visualize the electrostatic latent image.

The black developing device 21B is a fixed developing device at a developing position for effecting the developing operation, except upon the mounting and demounting thereof relative to the main assembly of the apparatus. A developing roller 21BS is disposed opposed to the photosensitive drum 15 with a small clearance (approx. 300 $\mu$m) therebetween. It develops an image to visualize a black image with black toner on the photosensitive drum 15.

The black developing device 21B, as shown in FIG. 1, feeds the toner from the toner accommodating container toward the developing roller 21BS by a feeding mechanism 21BA. The toner application blade 21BB press-contacted to the outer periphery of the developing roller 21BS applies the toner in the form of a thin layer on the outer periphery of the developing roller 21BS which is rotating in the indicated clockwise direction, and applies the charge to the toner (triboelectric charge). The developing roller 21BS is supplied with a developing bias, so that reverse development (jumping development) corresponding to the electrostatic latent image on the photosensitive drum 15 is effected to form a toner image on the surface of the drum.

In this embodiment, the toner capacity of the black developing device 21B is enough to print 15000 pages (A4, 5% print) which is larger than twice that of the toner capacity of Y, M, C developing devices, in consideration of the toner consumption corresponding to the nature of the documents or image patterns printed by users.

By this, the frequency of exchange of the black developing device by the users can be reduced.

The position of the black developing device 21B is, as shown in FIG. 1, is between the projection position where the photosensitive drum 15 is exposed to the beam from the laser scanner and a development position where the photosensitive drum 15 is subjected to a developing operation by the Y, M, C developing devices. Thus, the laser scanner is disposed above the developing devices. By the positional relation, the toner which might leak when the Y, M, C developing devices are revolved, is prevented from scattering to the optical parts such as a laser scanner. Therefore, the polygonal mirror, the lens, the mirror and the like are protected from toner deposition, so that sharp output images can be provided.

On the other hand, the three revolvable developing devices 20Y, 20M, 20C each contain the toner for 6000 pages (A4, 5% printing). The three revolvable developing devices are detachably mounted on a developing turret 23 which is revolvable about a shaft 22.

Upon the image formation, the turret 23 revolves about the shaft 22 while holding the Y, M, C developing devices to place a predetermined developing device to be faced to the photosensitive drum 15. The developing roller 20YS of the developing device placed at the development position is disposed opposed to the photosensitive drum 15 with a small clearance (300 $\mu$m approx.), and develops the electrostatic latent image on the photosensitive drum 15 into a visualized image.

Upon the color image formation, the developing turret 23 rotates for one rotation of the intermediary transfer member 9 so that developing processes are carried out in the order of yellow developing device 20Y, magenta developing device 20M, cyan developing device 20C and the black developing device 21B.

For example, when the yellow revolvable developing device 20Y is positioned at the developing position faced to the photosensitive drum unit, the yellow revolvable developing device 20Y feeds the toner from the container to the application roller 20YR by a feeding mechanism. By the functions of the application roller 20YR rotating in the clockwise direction and the blade 20YB press-contacted to the outer periphery of the developing roller 20YS, a thin layer of the toner is applied on the outer periphery of the developing roller 20YS rotating in the clockwise direction in FIG. 1, and the toner is triboelectrically charged. The developing roller 20YS is supplied with a developing bias so that latent image formed on upper is developed. The development is effected through the same process as to the magenta developing device 20M and the cyan developing device 20C. The application of the bias to each developing roller and the transmission of the driving force thereto is carried out when the developing device is placed at the developing position.

(Intermediary transfer member)

The intermediary transfer member 9 superimposedly receives four visualized toner images (Y, M, C, B) from the photosensitive drum 15. It is rotated in the clockwise direction as shown in FIG. 1 in synchronism with the outer peripheral speed of the photosensitive drum 15.

The superimposed toner images on the intermediary transfer member 9 are transferred all together by a transfer roller 10 supplied with a voltage, onto a recording material 2 fed to and nipped between the intermediary transfer member 9 and the transfer roller 10.

The intermediary transfer member 9 in this embodiment, comprises an aluminum cylinder 12 having a diameter of 186 mm and an elastic layer 11 such as intermediate resistance sponge, intermediate resistance rubber or the like on the outer periphery of the aluminum cylinder 12. The intermediary transfer member 9 is rotatably supported and is driven by a gear (unshown) fixed thereto.

(Cleaning means)

The cleaning means functions to remove the toner on the photosensitive drum 15 after the toner image provided by the developing means on the photosensitive drum 15 is transferred onto the intermediary transfer member 9. Thereafter, the removed toner is accumulation in the cleaner container 14. Normally, the amount of the removed toner accumulated in the container 14 does not fill the container 14 before the lifetime of the photosensitive drum is reached. Accordingly, normally the cleaner container 14 is exchanged integrally and simultaneously with the lifetime-end exchange of the photosensitive drum 15.

(Feeding portion)

The feeding portion functions to feed the recording material 2 into the image formation station. It comprises a cassette 1 for accommodating a plurality of recording materials 2, a pick-up roller 3, a feeding roller 4, a retarding roller 5 for preventing double feeding, a feeding guide 6 and a registration roller 8.

Upon image formation, the feeding roller 3 is rotated in accordance with the image forming operation to feed the recording materials 2 from the cassette 1 one by one. The recording material 2 separated and fed out, is guided by a guide 6, and introduced to the registration roller 8 by the feeding roller 7. During the image forming operation, the registration roller 8 rotates and stops at a predetermined sequence to feed the recording material 2 in synchronism with the transfer process.

(Transfer portion)

The transfer portion is provided with a swingable transfer roller 10. The transfer roller 10 comprises a metal shaft wrapped with an intermediate resistance foamed elastic member and a driving shaft, and is movable in the vertical direction in FIG. 1.

While the four color toner images are formed on the intermediary transfer member 9, that is, while the intermediary transfer member 9 is rotated a plurality of turns, the transfer roller 10 is at a lower position as shown in FIG. 1, and is separated from an intermediary transfer member 9 so that toner image is not disturbed.

After the four color toner images are formed on the intermediary transfer member 9, the transfer roller 10 is urged toward an upper position indicated by chain lines in FIG. 1 at a predetermined pressure toward the intermediary transfer member 9 at predetermined timing for transferring the color image onto the recording material 2. Simultaneously therewith, the transfer roller 10 is supplied with a bias voltage so as to transfer the toner image onto the recording material 2 from the intermediary transfer member 9.

The recording material 2 nipped between the intermediary transfer member 9 and the transfer roller 10, is advanced at a predetermined speed to the left in FIG. 1 during the transfer process, and is fed to a fixing device.

(Fixing portion)

The fixing station 25 functions to fix the toner image on the recording material. As shown in FIG. 1, the fixing portion 25 comprises a fixing roller 26 for applying heat to the recording material 2, a pressing roller 27 for press-contacting the recording material 2 to the fixing roller 26. These rollers are hollow and contain heaters 28, 29. By the rotation of the rollers, the recording material 2 is fed. The recording material 2 carrying the toner image is fed by the fixing roller 26 and the pressing roller 27, and simultaneously therewith, the heat and pressure are applied by which the toner image is fixed on the recording material 2.

(Black developing device)

Referring to FIGS. 3 to 18, the mounting of the black developing device to the main assembly and the positioning method therefor will be described, the black developing device being mountable and demountable relative to the main assembly separately from the above-described color developing devices.

Figure 3:
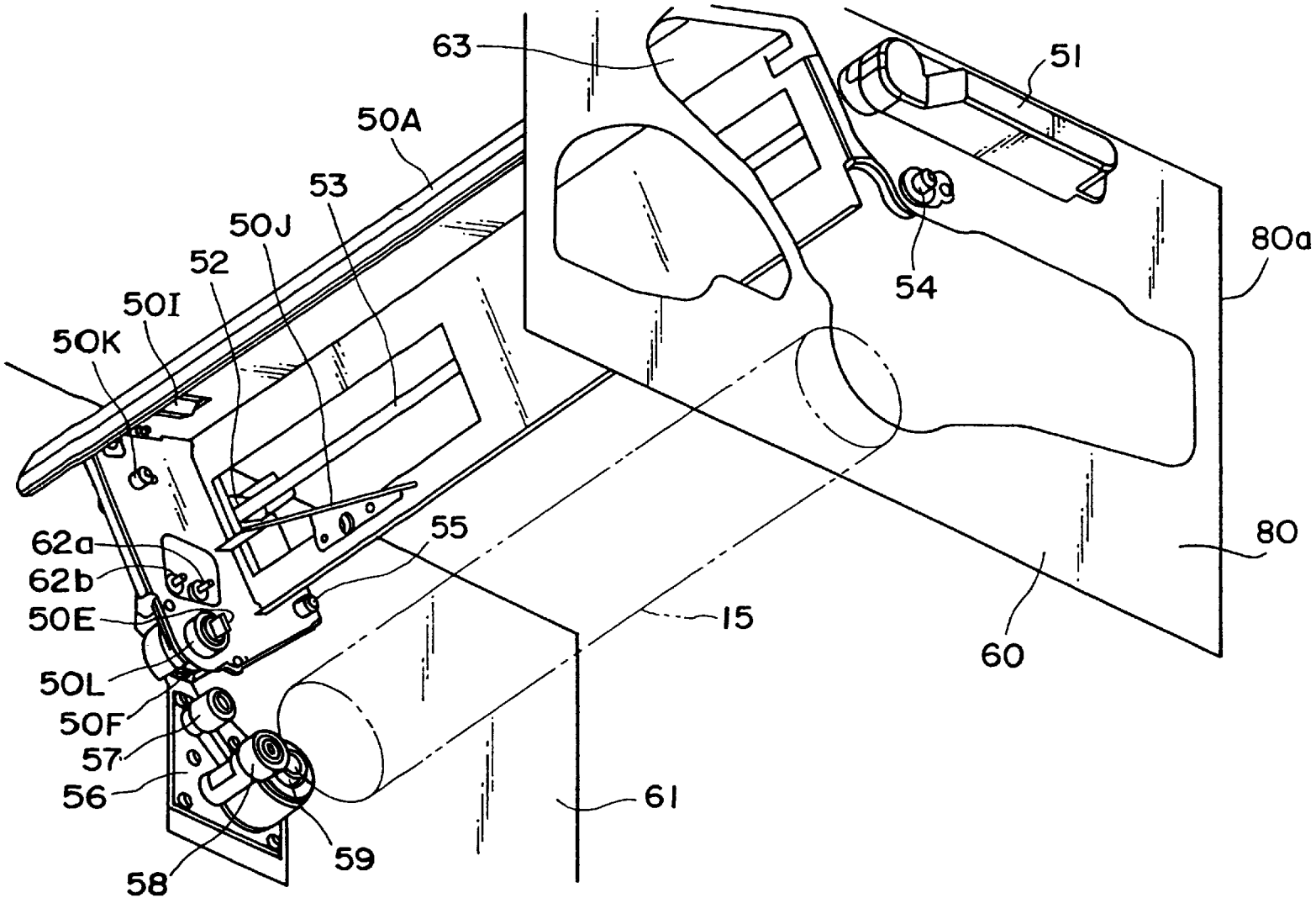
FIG. 3 is a perspective view of a black developing device before it is mounted to a swingable guide portion.
Figure 4:
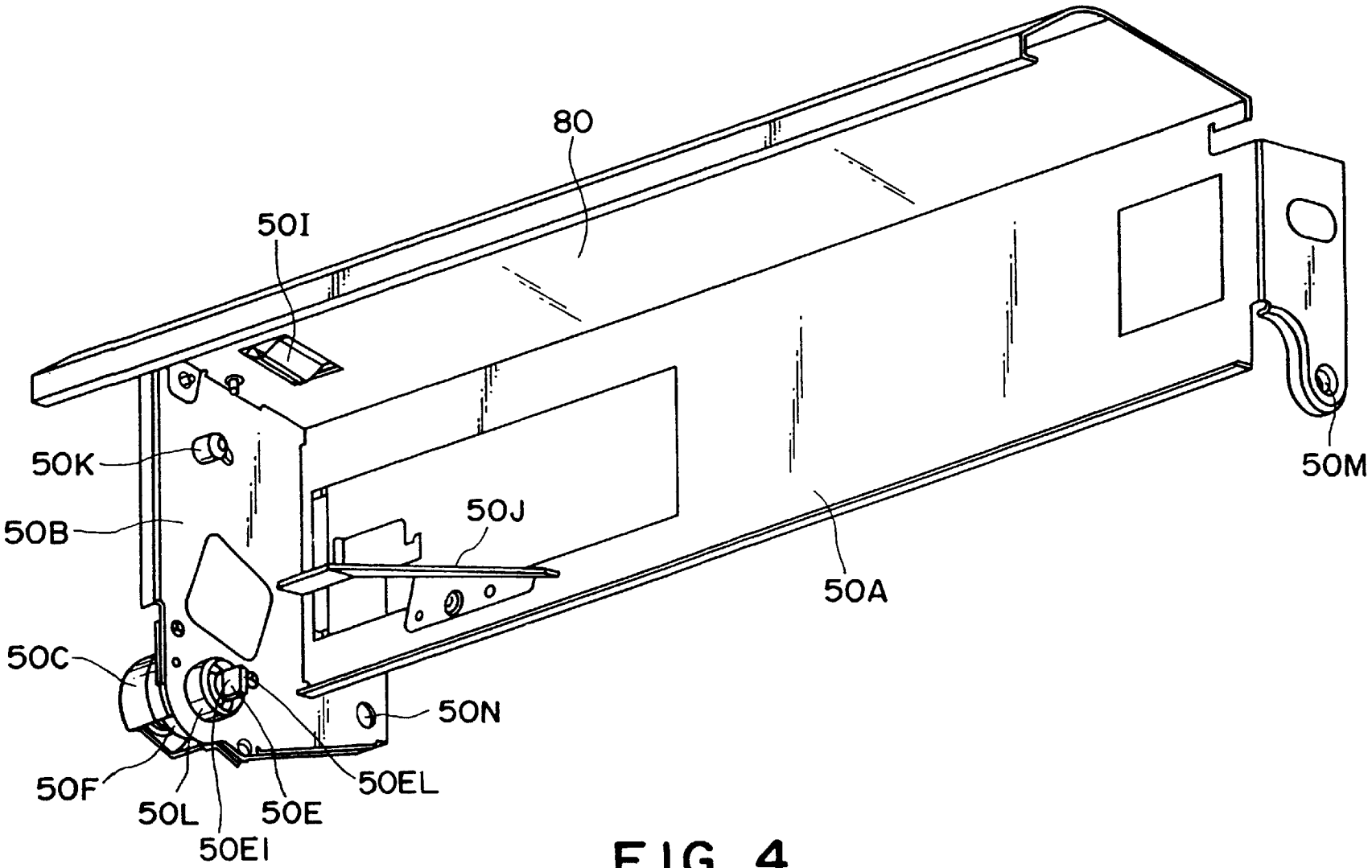
FIG. 4 is a perspective view of a swingable guide portion.
Figure 5:
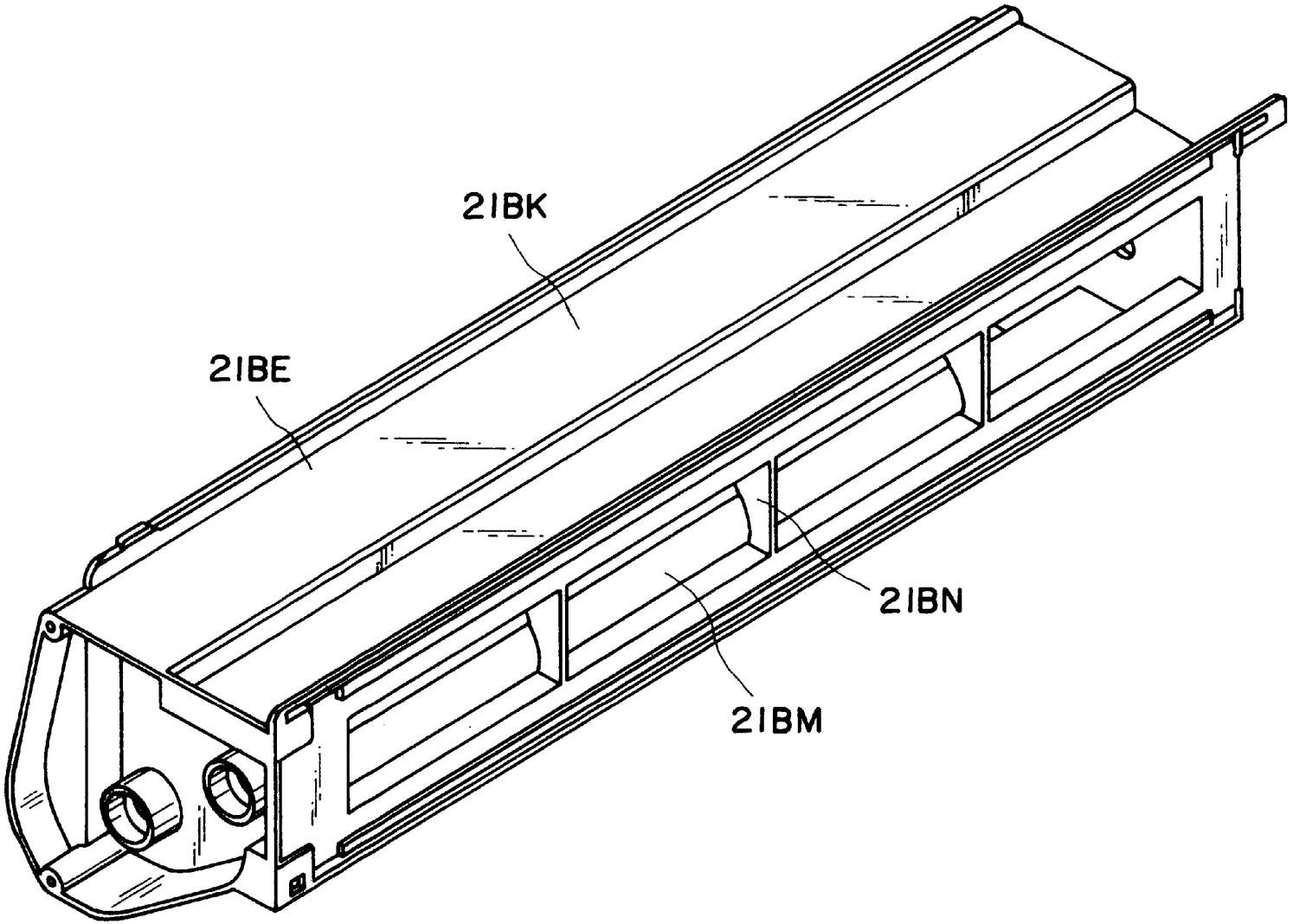
FIG. 5 is a perspective view of a toner accommodating portion of a black developing device.
Figure 6:
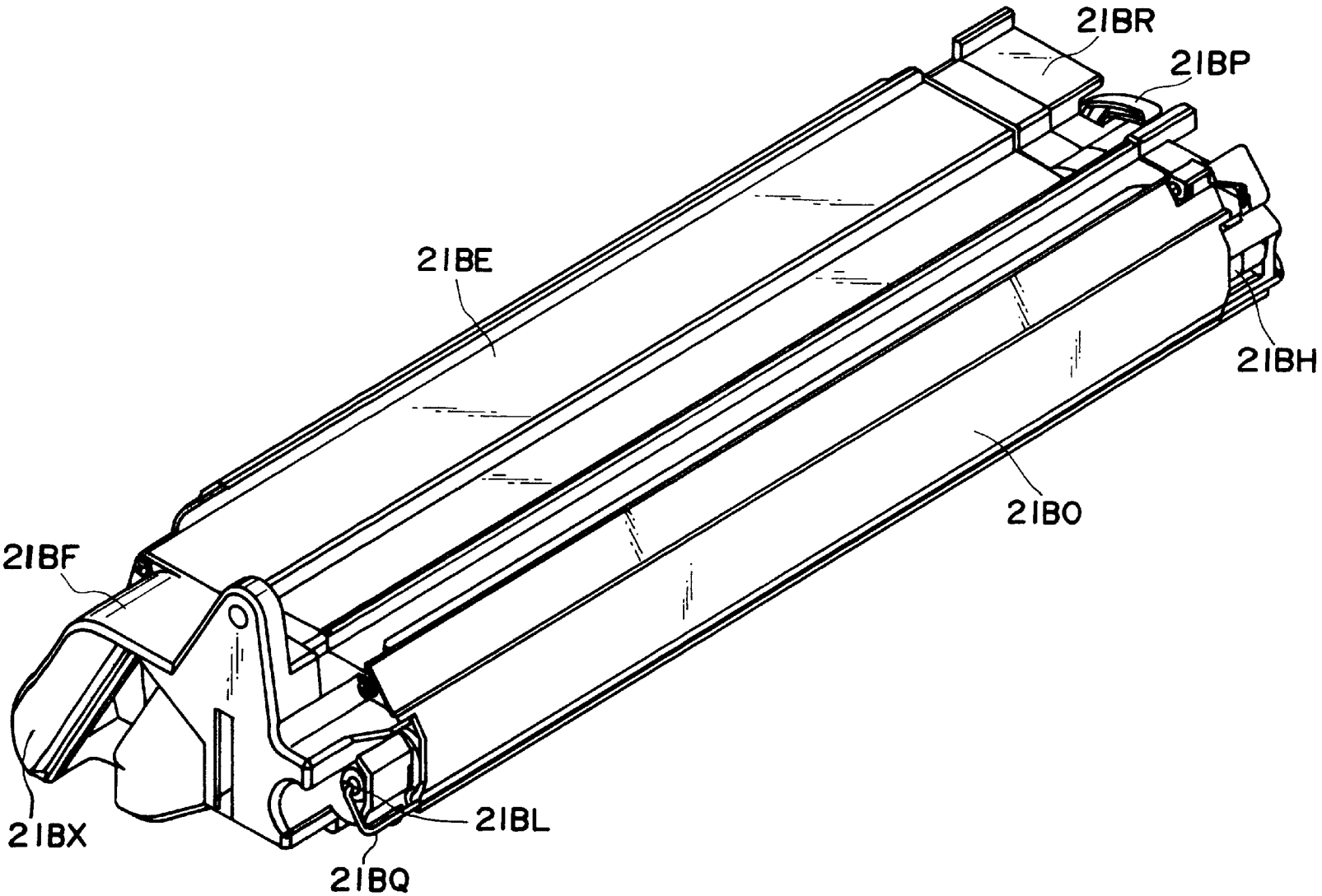
FIG. 6 is a perspective view of an outer appearance of a black developing device.
Figure 7:
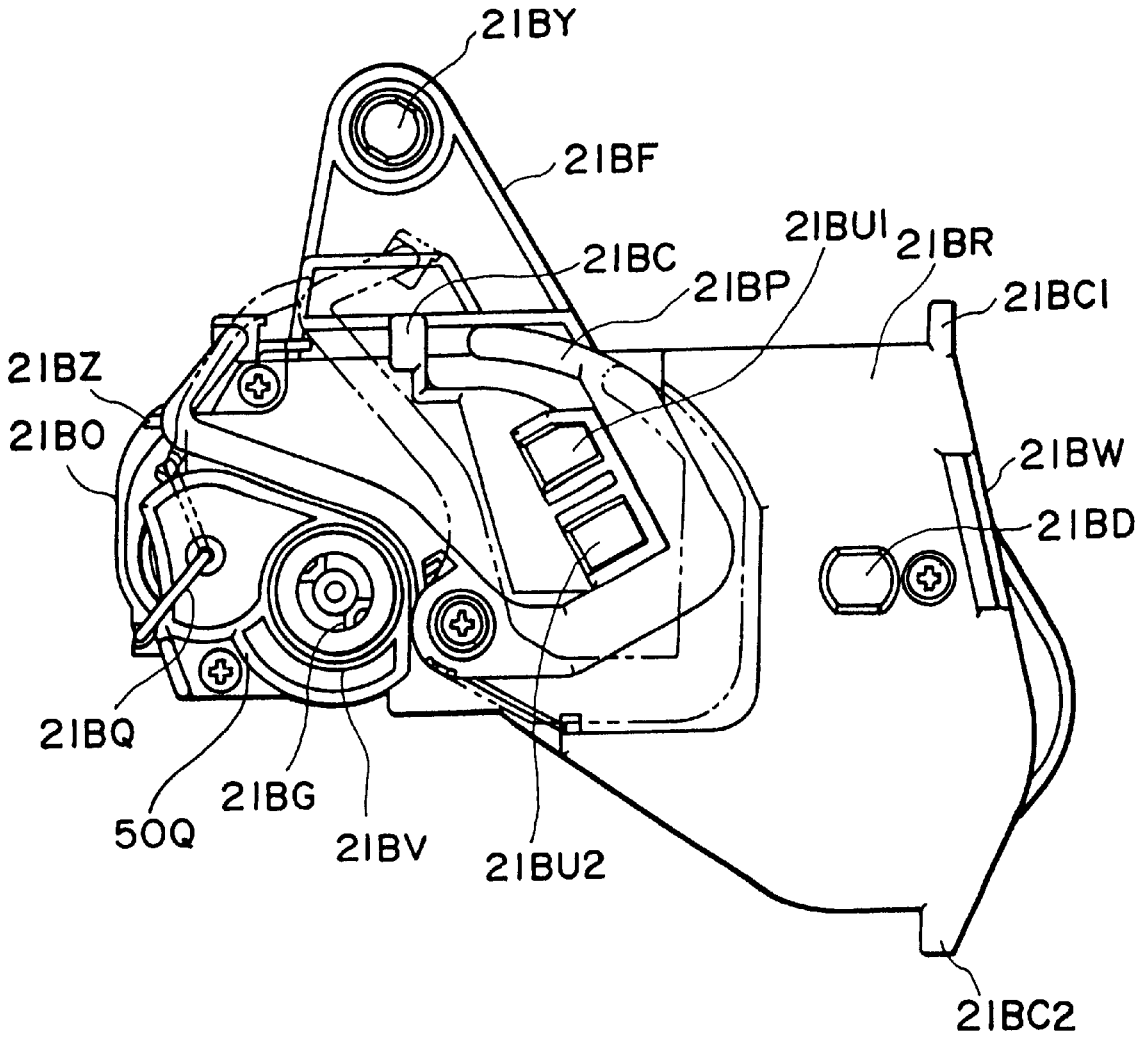
FIG. 7 is a side view of a rear side of a black developing device.
Figure 8:
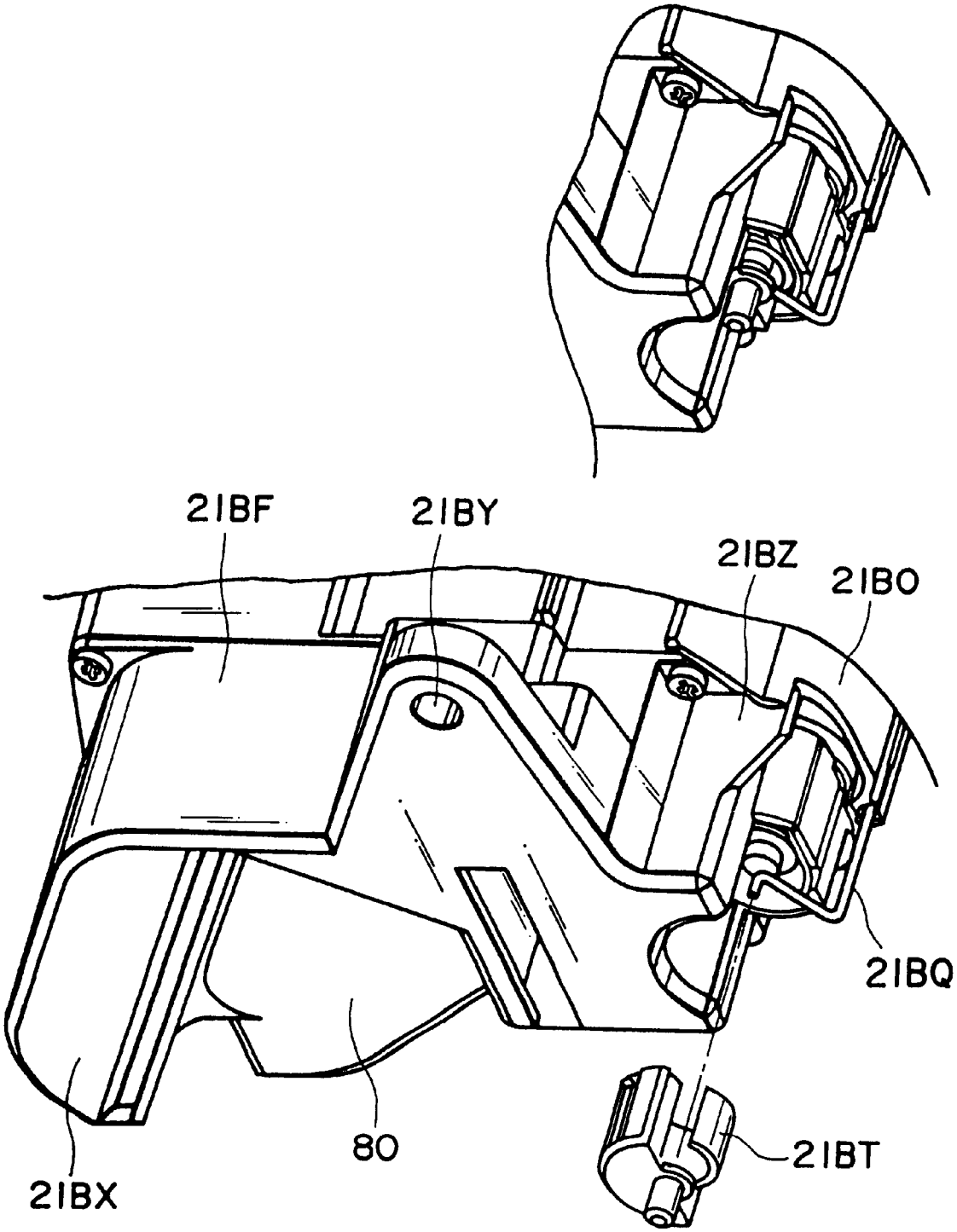
FIG. 8 is a perspective view of a front side of a black developing device.
Figure 9:
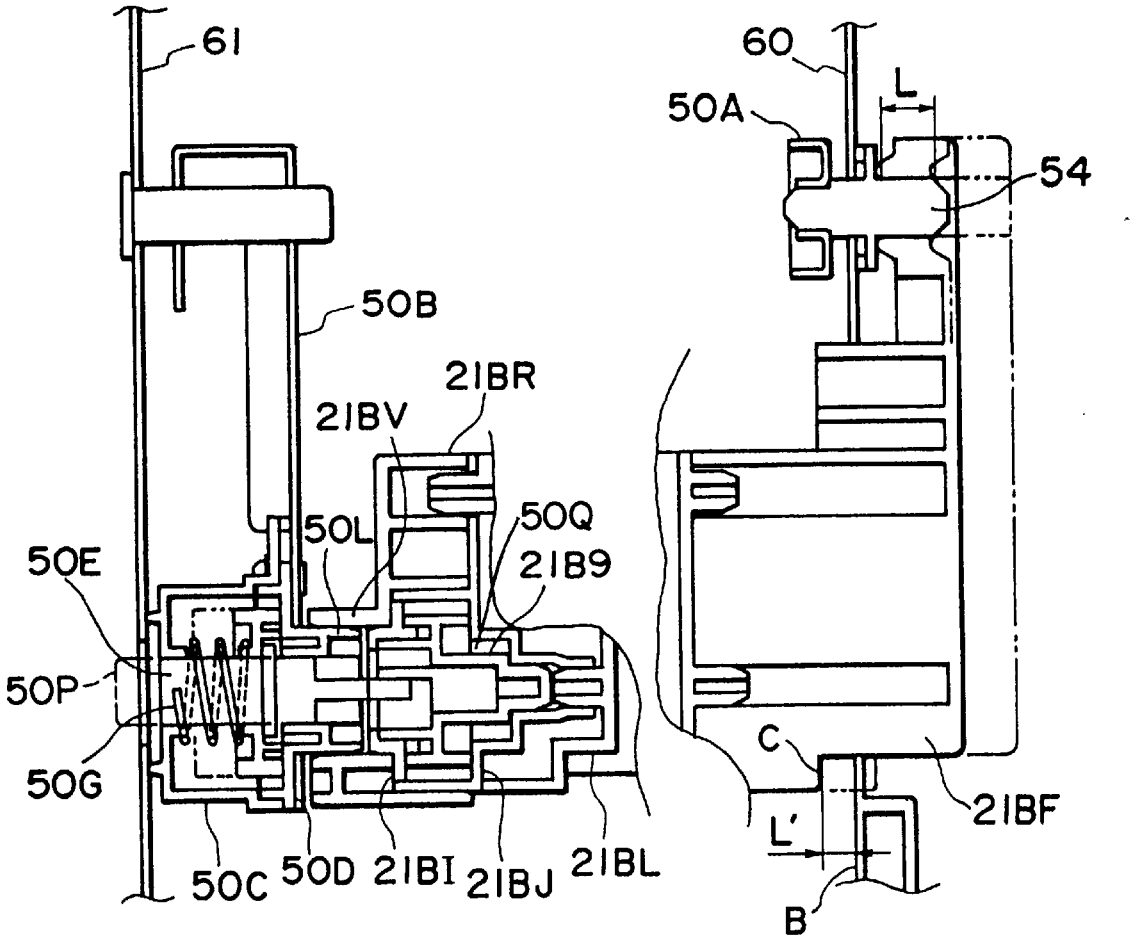
FIG. 9 is a sectional view of a drive transmission structure to a black developing device.
Figure 10:
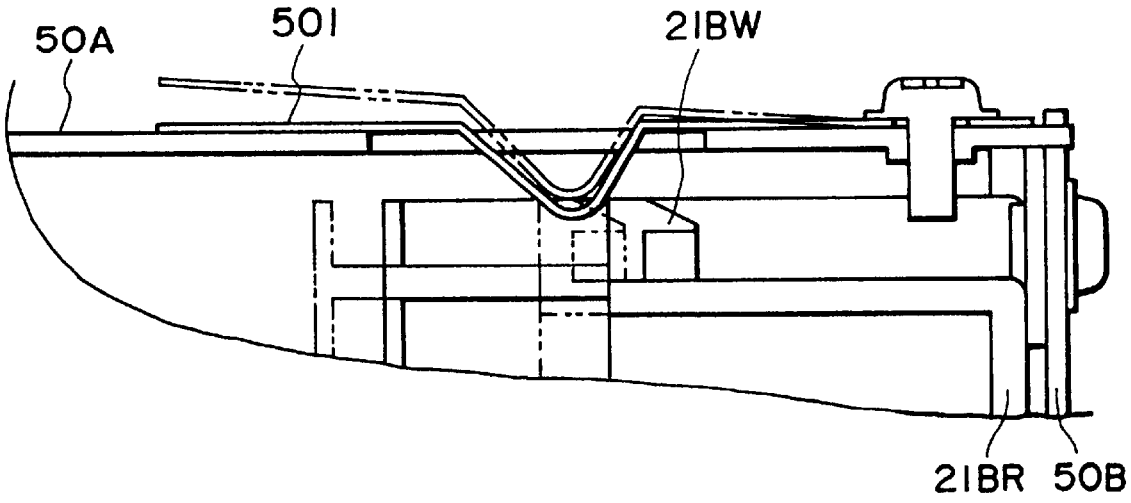
FIG. 10 is an illustration which a state in which black developing device and a swingable guide portion are engaged with each other.
Figure 11:
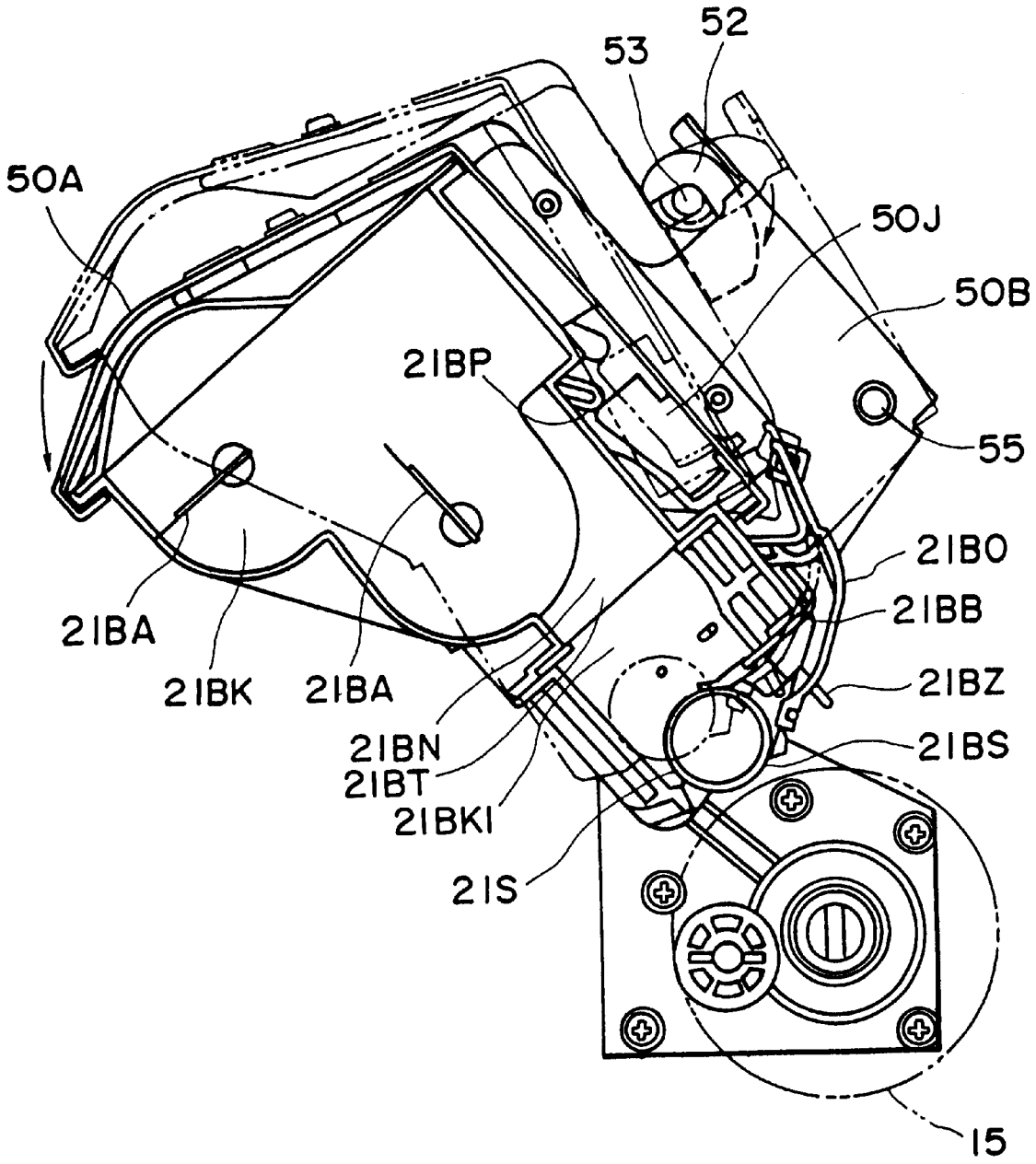
FIG. 11 is a cross-sectional view of a black developing device which is mounted.
Figure 12:
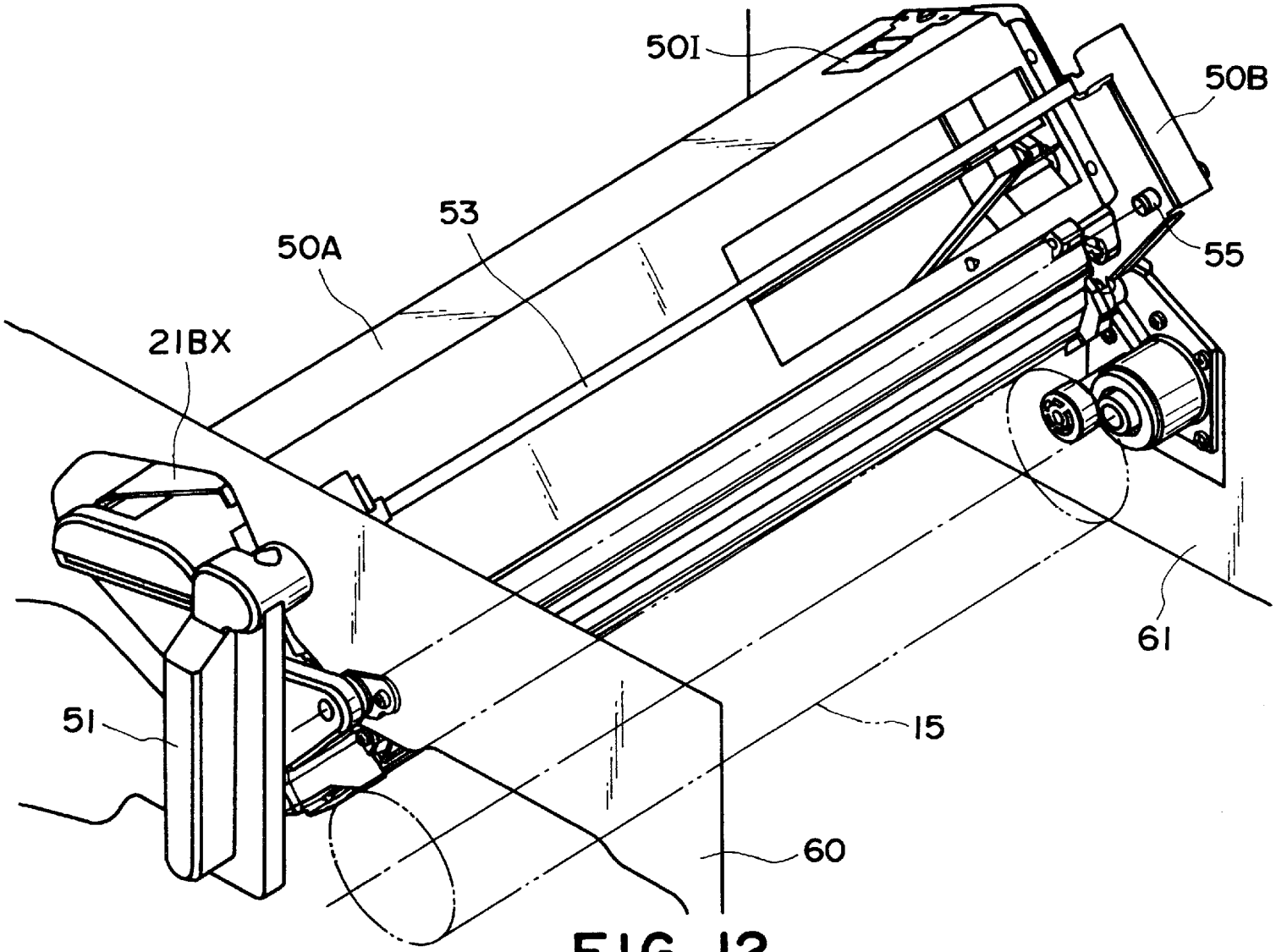
FIG. 12 is a perspective view of a black developing device which is mounted to a swingable guide portion and which is contacted to a photosensitive drum.
Figure 13:
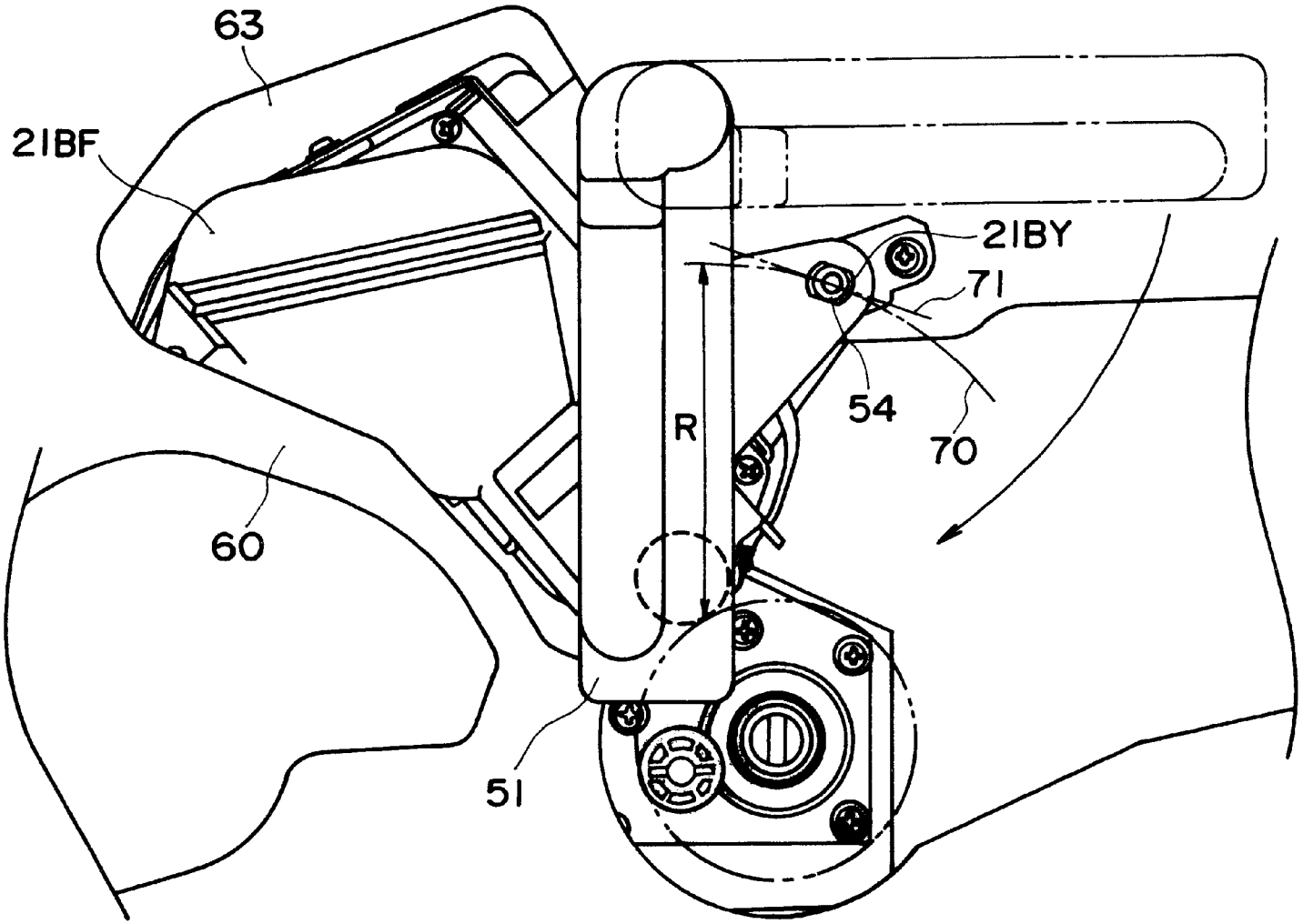
FIG. 13 is a side view of a front side, in the mounted state, of a black developing device.
Figure 14:
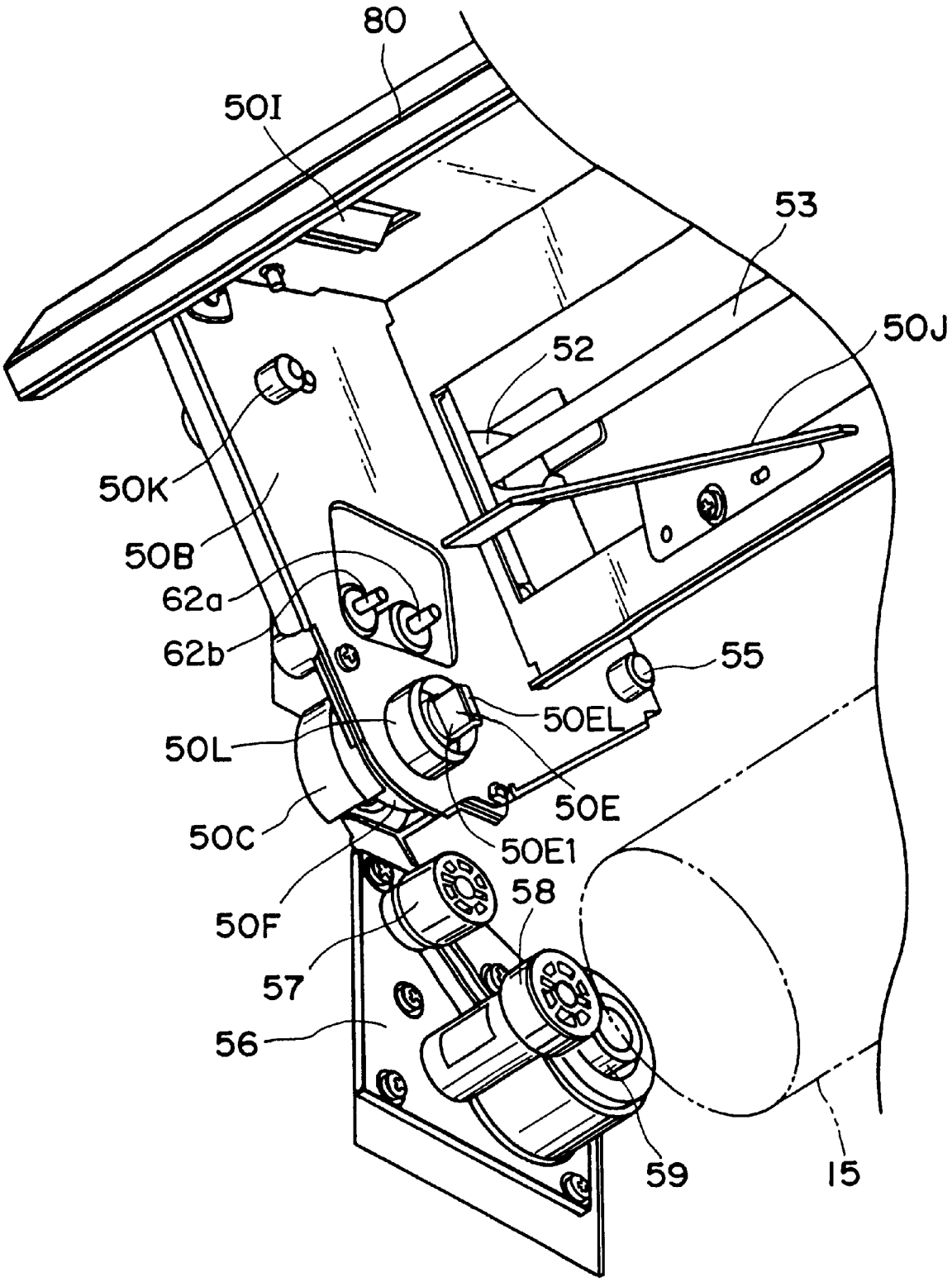
FIG. 14 is an enlarged view of a rear side of a black developing device when it is mounted.
Figure 15:
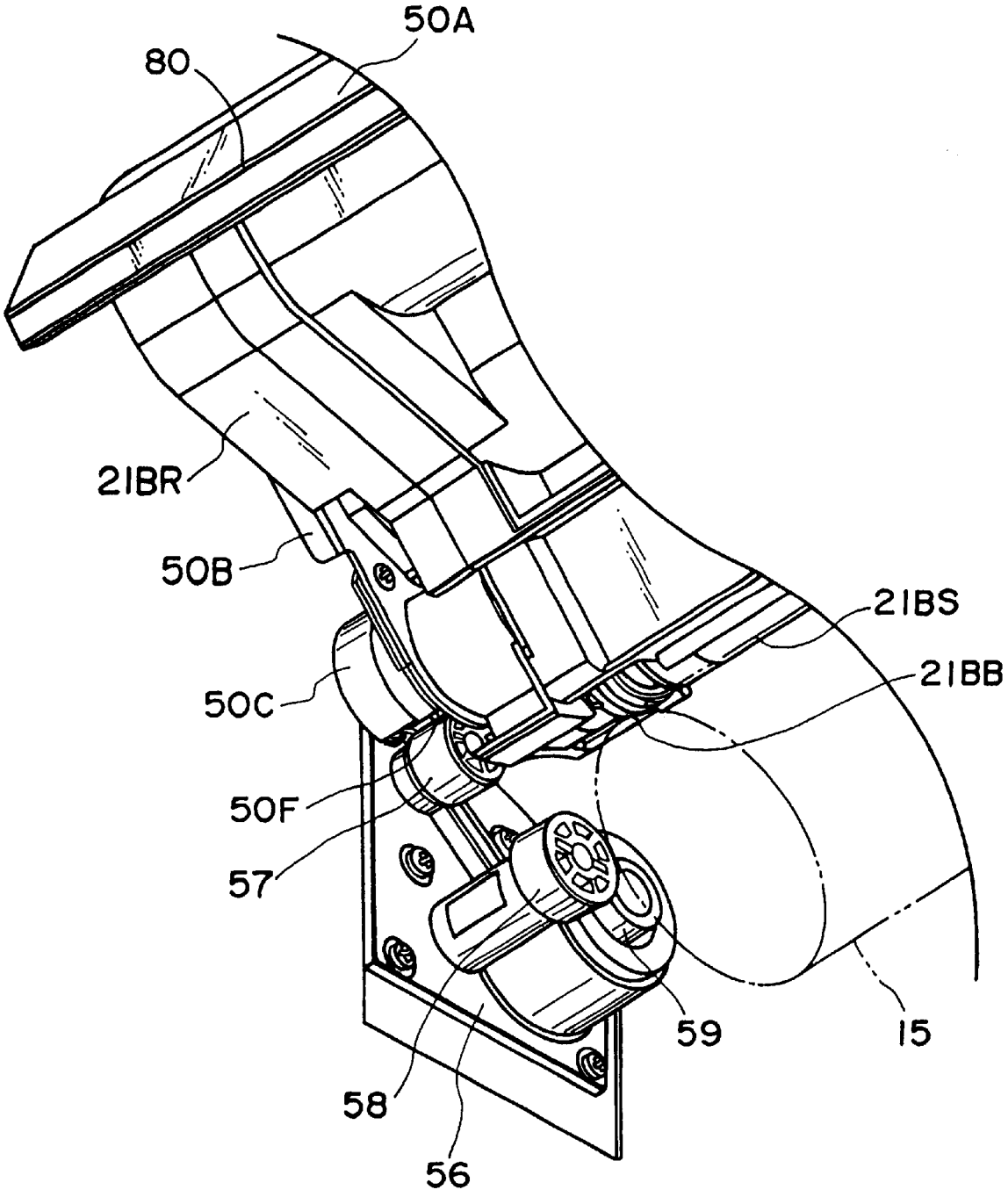
FIG. 15 is an enlarged view of a rear side of a black developing device when it is mounted.
Figure 16:
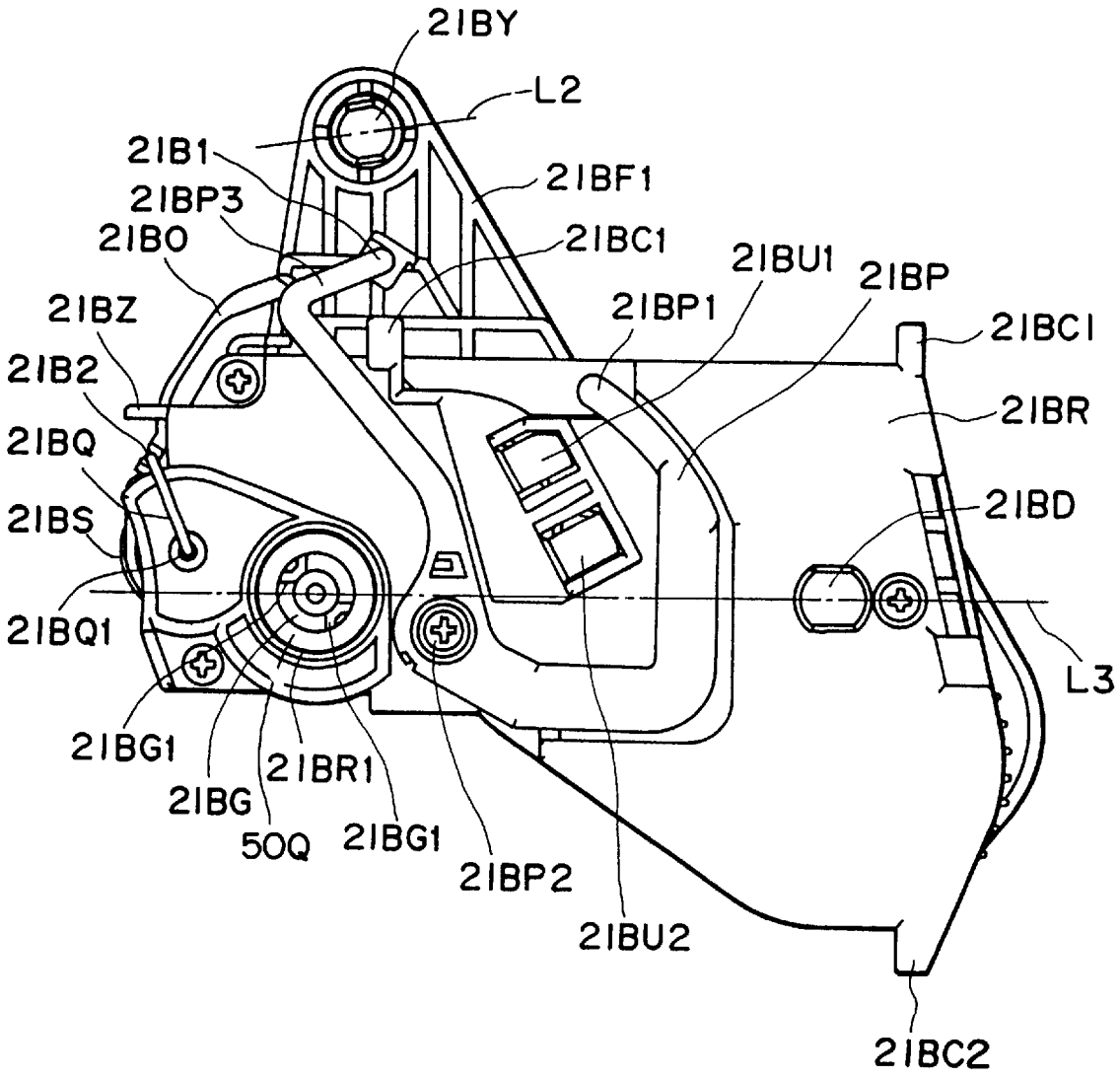
FIG. 16 is a front view of a black developing device as seen from a downstream side in a direction along which it is mounted to the main assembly (it is mounted to the main assembly).
Figure 17:
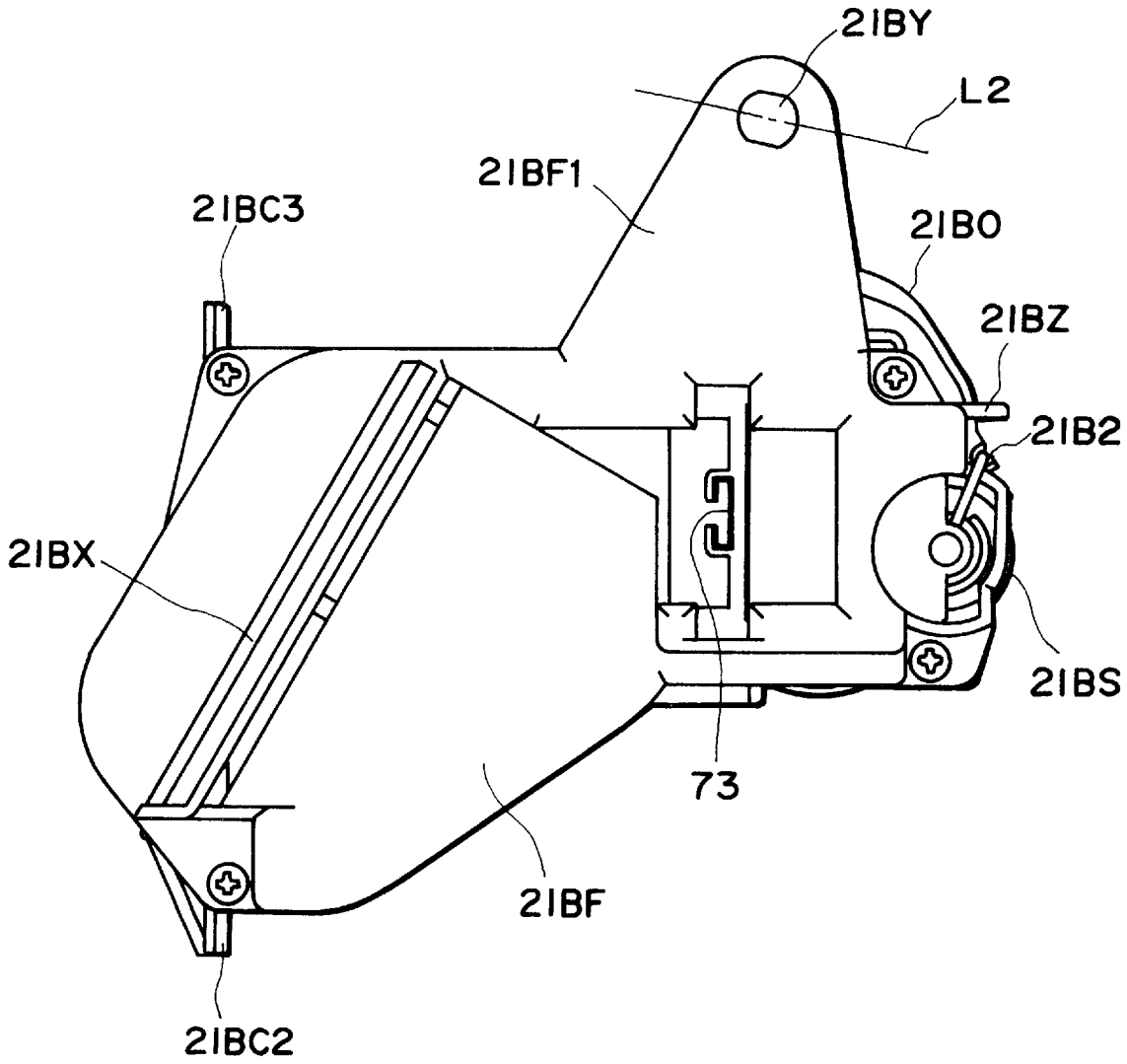
FIG. 17 is a rear view of a black developing device as seen from a downstream side in a direction along which it is mounted to the main assembly (it is mounted to the main assembly).
Figure 18:
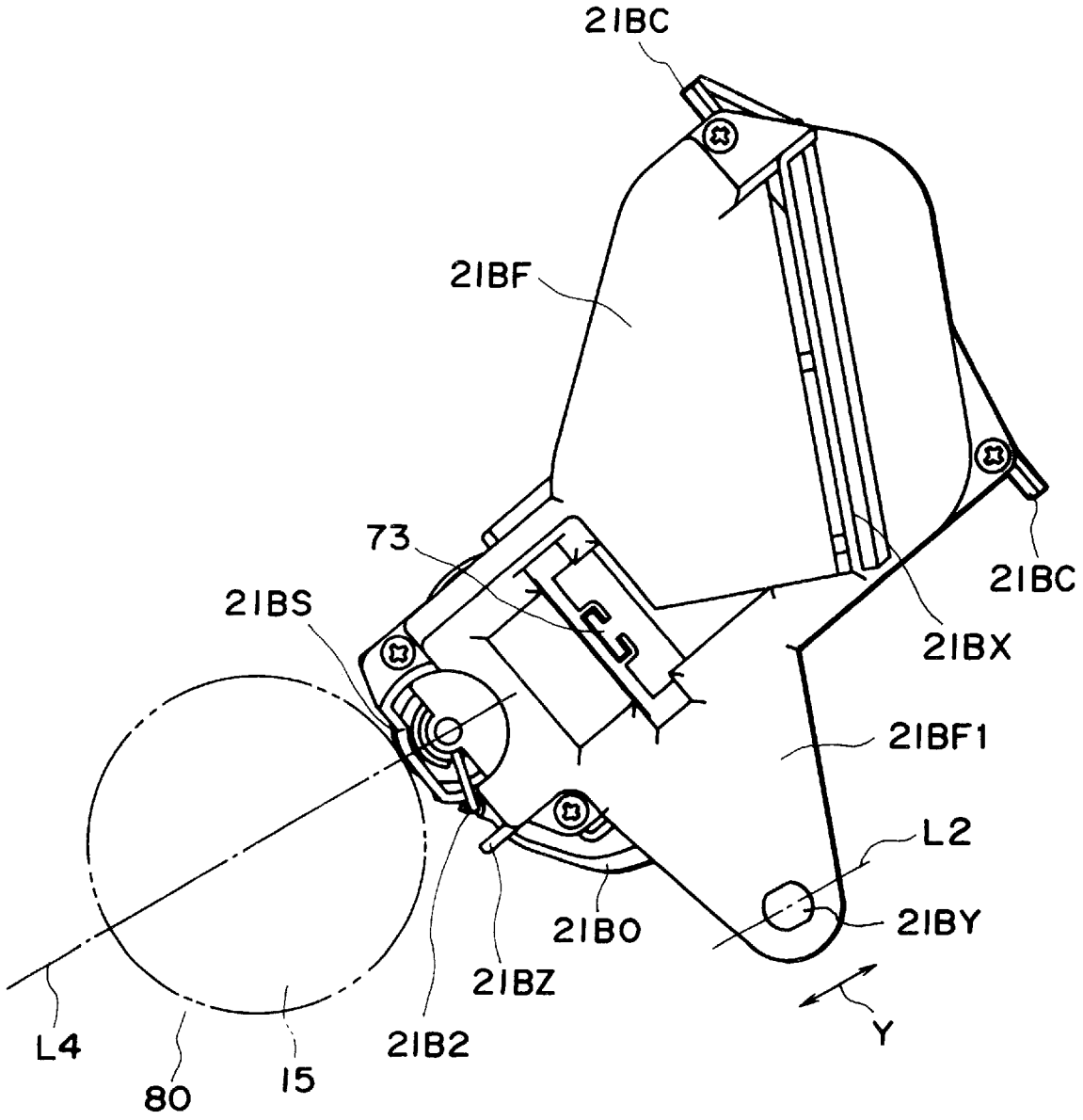
FIG. 18 is a side view of a black developing device which is at a developing position of the main assembly of the apparatus.

FIG. 3 is a perspective view of a black developing device 21B before it is mounted to a swingable guide portion 50. FIG. 4 is a perspective view of a swingable guide portion. FIG. 5 is a perspective view of a toner accommodating portion 21BK of a black developing device 21. FIG. 6 is a perspective view of an outer appearance of a black developing device 21B. FIG. 7 is a side view of a rear side of the black developing device 21B. FIG. 8 is a perspective view of a front side of a black developing device 21B. FIG. 9 is a sectional view of a drive transmission structure to a black developing device 21B. FIG. 10 is an illustration which a state in which black developing device 21B and a swingable guide portion 50 are engaged with each other. FIG. 11 is a sectional view when the black developing device is mounted. FIG. 12 is a perspective view of a black developing device 21B which is mounted to a swingable guide portion 50 and which is contacted to a photosensitive drum 15. FIG. 13 is a side view of a front side when the black developing device is mounted. FIG. 14 and FIG. 15 are enlarged views of the rear side when the black developing device is mounted to the main assembly of the apparatus. FIG. 16 is a side view of a leading side (with respect to the direction of mounting of the developing device to the main assembly) when the black developing device 21B is mounted to the main assembly, and FIG. 17 is a side view of a trailing side thereof, and FIG. 18 is a side view when the black developing device is at the developing position of the main assembly. In following description, the side of the main assembly which is at the leading side in the black developing device 21B inserting direction is called "rear side", and the side of the main assembly at the trailing side is called "front side".

The black developing device 21B comprises a housing and a developing roller 21BS rotatably mounted thereto, said housing comprising a first housing 21BE including a toner accommodating portion, a holders 21BF, 21BR which are a second housing, at the longitudinal opposite sides thereof. The housing is provided with an openable shutter 21BO for protecting the developing roller 21BS, and the black developing device 21B is detachably mountable relative to the swingable guide portion 50 of the main assembly 80 of the apparatus.

(Mounting of the black developing device)

The swingable guide portion 50 has a swingable side plate 50B fixed to the rear side of the swingable guide 50A. The swingable guide 50A has a swing hole 50M at the front side, and the rear side swingable side plate 50B has a swing hole 50N.

The front side plate 60 of the main assembly 80 has a first swing shaft 54 fixed thereto, and the rear side plate 61 has a second swing shaft 55 fixed thereto. The first swing shaft 54 and the second swing shaft 55 are engaged with the swing hole 50M and the swing hole 50N, respectively.

The swingable guide portion 50 is swingable about the swing shafts 54, 55 by the engagement between the swing shaft 54, 55 and the holes 50M, 50N. An axis connecting the first swing shaft 54 and the second swing shaft 55 is parallel with a generating line of the photosensitive drum 15, and the swingable guide portion 50 is swingable in a direction perpendicular to the generating line of the photosensitive drum 15. Thus, the developing roller 21BS of the black developing device 21B mounted to the swingable guide portion 50 becomes parallel with the photosensitive drum 15.

The swingable guide portion 50 is swung by a rotation lever 51. The rotation lever 51 is disposed at the front side 80*a* (FIG. 2) of the main assembly 80. A cam 52 is fixed coaxially to a rotation lever shaft 53 of the rotation lever 51, and rotates in the same phase as the rotation of the rotation lever 51. When the rotation lever 51 is rotated, the cam 52 rotates, and the outer surface of the cam 52 slides on the swingable guide 50A and the swingable side plate 50B. By the sliding operation, the swingable guide portion 50 swings vertically about the swing shafts 54, 55.

In this embodiment, the rotation lever 51 is rotatable from a horizontal position to a vertical position through approx. 90°, by which the swingable guide portion 50 swings about 10°.

When the black developing device 21B is inserted into the main assembly 80, the rotation lever 51 is rotated to the horizontal position. At this time, as shown in FIG. 3, an insertion opening 63 formed in a front side 80*a* of the main assembly 80 is completely opened. When a fresh black developing device 21B is used, the user shakes the black developing device 21B sufficiently, and then, a toner seal 21BT (FIG. 11) is pulled out, and loads the black developing device 21B into the main assembly 80. The shaking is to loosen or uncake the toner in the toner accommodating portion 21BK.

If, however, the user shakes the black developing device 21B in its longitudinal direction, or if, after the shaking, the user holds it vertically, a larger amount of the uncaked toner may be at one side. However, in this embodiment, as shown in FIG. 5, there are provided a plurality of partitions 21BN adjacent the opening 21BM of the toner accommodating portion 21BK, and therefore, the problem can be avoided.

After the preparation for the mounting of the black developing device 21B is completed, the user holds the black developing device 21B horizontally, and inserts it into the insertion opening 63. As shown in FIG. 6, the holder 21BR at the black developing device 21B side is provided with a guide rib 21BC which is roughly aligned with the entrance of the swingable guide 50A. There is a nominal play of 0.5–2 mm between the guide rib 21BC and the entrance of the swingable guide 50A. Therefore, the user roughly aligns the black developing device 21B with the entrance of the swingable guide 50A, and then, pushes it toward rear side, thus smoothly loading it.

The black developing device 21B is provided with a shutter 21BO for protecting the developing roller 21BS, the shutter 21BO being rotation. To the holder 21BR disposed at a rear side of the black developing device 21B, a shutter openable member 21BP is positioned for rotation about the 21BP1, and is pushed in one direction by a spring (unshown). The shutter shaft 21BQ is extended bridging beyond the holder 21BF disposed at the front side 80*a*, and is supported rotatably on a shaft 21BQ1 coaxial with the developing roller 21BS.

One supporting portion 21B1 of the shutter 21BO is supported on a shutter opening member 21BP, and the other supporting portion 21B2 is supported by the shutter shaft 21BQ. More particularly, the shutter 21BO is supported at two positions in a cross-sectional plane by the shutter opening member 21BP and the shutter shaft 21BQ. With this state, when the other end portion 21BP1 of the shutter opening member 21BP receives a rotation moment in a direction perpendicular to the generating line of the photosensitive member 15, the shutter opening member 21BP rotates about the shaft 21BP2, so that shutter 21BO rotates smoothly. The FIG. 7 shows the shutter 21BO when it is at the closing position.

In this embodiment, as shown in FIGS. 7 and 11, there is provided a stopper 21BZ in the form of a projection in the rotation region of the shutter shaft 21BQ, so that movement of the shutter 21BO in the opening direction is stopped by abutment of the shutter shaft 21BQ to the stopper 21BZ.

In this embodiment, the end of the rotation center shaft 21BQ1 of the shutter shaft 21BQ is inserted in holes 21BL (only front side is shown) formed in the front side holder 21BF and the rear side holder 21BR. As shown in FIG. 6, the holder 21BF at the front side is provided with a hole 21BL in the form of a cut-away portion into which an end of the shutter shaft 21BQ can be press-fitted in a radial direction. With this structure, the assembling can be carried out easily by press-fitting the shutter shaft 21BQ into the hole 21BL.

As shown in FIG. 8, the end of the shutter shaft 21BQ may be mounted to the side surface of the holder 21BF, using a shutter bearing 21BT. In such a case, the mounting can be carried out in the same direction as the generating line of the photosensitive drum 15, and then, the mounting is further easier.

To make the shutter opening member 21BP rotatable, the swingable guide portion 50 is provided with a guiding member 50J as shown in FIGS. 3 and 4 in this embodiment. The guiding member 50J is fixed to the swingable guide 50A, and has a wall surface in the form of a non-acute inclined surface. When the user inserts the black developing device 21B into the swingable guiding member 50 to a certain extent, the other end portion 21BP1 of the shutter opening member 21BP is abutted to the guiding member 50J. With further insertion of the black developing device 21B, the other end portion 21BP3 of the shutter opening member 21BP is moved along the inclined surface formed in the guiding member 50J. When the motion of the shutter opening member 21BP is seen in the cross-section, the shutter opening member 21BP is rotating about 21BP2. With such a structure, the shutter 21BO is opened and closed in interrelation with the inserting operation of the black developing device 21B.

In order to rotate the shutter opening member 21BP smoothly, the angle of the inclined surface portion of the guiding member 50J is desirably not more than 45°, and in this embodiment it is approx. 15°. When the length of the black developing device 21B is short (for A4 size), the opening and closing operation has to be carried out through a short stroke, and therefore, the inclined surface portion of the guiding member 50J is larger than 15° and not more than 45°.

(Positioning and drive transmission at the rear side of the black developing device)

The side surface of the holder 21BR at the rear side of the black developing device 21B is provided with a drive input engaging portion 21BV and a second positioning hole 21BD functioning as the positioning portion for positioning it relative to the swingable guide portion 50. On the other hand, the swingable side plate 50B of the swingable guide portion 50 is provided with a drive transmission engaging portion 50L and a second positioning shaft 50K.

As shown in FIG. 9, when the black developing device 21B is inserted into the swingable guide portion 50A, the drive transmitting portion provided in the swingable guide portion 50A and the driving force input portion of the black developing device 21B are coupled.

The driving force transmitting portion 50P comprises a drive transmitting shaft 50E for transmitting the driving force to the driving force input portion 50Q of the black developing device 21B, a drive transmission gear 50F (FIG. 4) for transmitting the rotation force to the drive transmitting shaft 50E, and a drive transmission engaging portion 50L engageable with the driving input engaging portion 21BV provided in the driving force input portion 50Q of the black developing device 21B. The driving force input portion 50Q has a driving input gear 21BG for drive transmission of the driving force received by the engaging portion 21BV to the developing roller 21BS.

Referring to FIGS. 4 and 9, the structure of the driving force transmitting portion 50P and the driving force input portion 50Q will be described. A side surface of the transmission shaft 50E is supported by the housing 50C and the housing 50D. The drive transmitting shaft 50E has a drive transmission gear 50F fixed thereto, and is urged in one direction by a driving shaft confining spring 50G. Drive transmission engaging portion 50L is coaxially and integrally with the drive transmitting shaft 50E. Therefore, the drive transmitting shaft 50E is rotatable coaxially with the drive transmission engaging portion 50L.

As shown in FIG. 4, the engaging portion 50L is circular. When the black developing device 21B is mounted to the main assembly 80 of the apparatus, the circular portion of the engaging portion 50L is engaged with the circular engaging portion 21BV of the developing device 21B. By this, the developing device 21B is positioned relative to the main assembly 80 at the rear side.

On the other hand, the female coupling recess 21BG in the black developing device 21B is supported by developing roller driving bearings 21BI, 21BJ at the opposite ends. The developing roller driving bearing 21BI is supported by the driving input engaging portion 21BV formation in the holder 21BR. The center of rotation of the female coupling recess 21BG is coaxial with the drive transmission engaging portion 50L. Thus, the developing roller driving gear 21BG is rotated coaxially with the drive transmission engaging portion 50L. The female coupling recess 21BG is provided inside the outer surface of the holder 21BI. This is because the circular portion of the drive transmission engaging portion 50L is engaged therewith.

With this structure, when the drive transmission engaging portion 50L is inserted into the driving input engaging portion 21BV, the drive transmitting shaft 50E is rotated coaxially with the developing roller driving gear 21BG. The developing roller driving gear 21BG drives the developing roller gear 21BH (FIG. 6) to rotate the developing roller 21BS. In this embodiment, the drive transmission for the black developing device 21B is effected by the coupling engagement, the rotation non-uniformity of the developing roller 21BS can be reduced.

In this embodiment, one end of the drive transmitting shaft 50E has an I-configuration 50EI (FIG. 4) having two cut surfaces. On the other hand, an end of the developing roller driving gear 21BG has two walls 21BG1 at symmetrical positions (FIG. 7). When the black developing device 21B is inserted, the shaft end surface 50EL of the I-configuration is inserted between the walls 21BG1 of the developing roller driving gear 21BG to transmission the driving force.

When the shaft end surface 50EL of drive transmitting shaft 50E is not aligned in phase with the wall 21BI of the developing roller driving gear 21BG upon the insertion of the black developing device 21B, the shaft end surface 50EL of the drive transmitting shaft 50E interferes the end 21BG1 of the developing roller driving gear 21BG, and therefore, the driving force transmission is not accomplished. However, in this embodiment, the drive transmitting shaft 50E is press-contacted in one direction by the confining spring 50G, and therefore, when the drive transmitting shaft 50E rotates a certain extent, the shaft end surface 50EL is engaged between the walls 21BG1 of the driving gear 21BG, so that driving force transmission is enabled.

When the user pushes the black developing device 21B into the rear side of the swingable guide portion 50, the driving input engaging portion 21BV and the second positioning hole 21BD are brought into engagement with the drive transmission engaging portion 50L and the second positioning shaft 50K. By the two positioning portions, the rear side of the black developing device 21B is correctly positioned relative to the swingable guide portion 50, and the position thereof is determined in the direction perpendicular to the generating line of the photosensitive drum.

In this embodiment, before the positioning is finally determined, the opening action of the shutter 21BO is completed.

At the rear side of the swingable guide 50A, a regulating member 50I for the black developing device is disposed. The regulating member 50I is engaged with an engaging portion 21BW (FIG. 7) formed at the rear side of the black developing device 21B. By this engagement, the black developing device 21B is confined in the position thereof in the direction of the generating line of the photosensitive drum.

As shown in FIG. 10, when the user is pushed the black developing device 21B to the rear, the black development regulating member 50I having a resiliency enters the engaging portion 21BW, so that user feels that black developing device 21B is set at the regular position. The regulating member 50I prevents the black developing device 21B from offsetting toward the user, when the rotation lever 51 is rotated to swing the black developing device 21B and the swingable guide portion 50.

With this state, when the user rotates the lever 51 to rotate the swingable guide portion 50A into a set position, the drive transmission gear 50F fixed to the drive transmitting shaft 50E is brought into engagement with the black developing device driving gear 57 which is provided in the driving unit 56 of the main assembly 80 and which is connected with the driving source (unshown). By this, the drive transmission gear 50F is connected with the driving source to permit rotation of the developing roller 21BS.

The driving unit 56, as shown in FIGS. 14 and 15, is provided with a color developing device driving gear 58 connected with the driving source (unshown) and a drum driving gear 59 to transmit the driving force to the developing devices 21M, 21C, 21Y and to the photosensitive drum 15.

(Positioning of the black developing device at the front side)

A front side holder 21BF for the black developing device 21B is provided with an elongated hole 21BY functioning as a pivot of the swing of the black developing device 21B, as shown in FIGS. 7 and 8. When the black developing device 21B is inserted into the swingable guide portion 50, the elongated hole 21BY functions an engaging portion for engagement with the swing shaft 54 arranged on the side plate 60 at the front side 80*a* of the main assembly 80.

Depending on the part accuracy of the black developing device and the main assembly 80, it is not possible to completely remove the error in parallelism between the generating line of the photosensitive drum and the axis of the pivot. Therefore, in this embodiment, the elongated hole 21BY is formed so as to provide a play of 0.5 mm–1.0 mm approx. to accommodate the variation in the parts.

The direction of the elongated hole 21BY, as shown in FIG. 13, is substantially the same as a direction 71 of the tangent line of an arcuation 70 having a center at the position of contact between the black developing device 21B (gap roller 21S) and the photosensitive drum 15 and passing through the pivot of the black developing device 21B.

In other words, the distance R (radius, or length of the arm) (FIG. 13) from the contact point between the black developing device 21B and the photosensitive drum 15 to an any portion of the elongated hole 21BY is constant. By this direction of the elongated hole 21BY, the parallelism deviation between the generating line of the developing roller 21BS and the generating line of the photosensitive drum 15 can be minimized, even if the swing shaft 54 is deviated toward one side of the elongated hole.

(Setting of the black developing device at the developing position)

As described in the foregoing, when the user rotates the rotation lever 51 in the clockwise direction with the black developing device inserted and positioned, the black developing device 21B and the swingable guide 50A swing integrally downwardly. At this time, gap rollers 21S (FIG. 11) provided at the opposite ends of the developing roller 21BS are contacted to photosensitive drum 15.

The gap rollers 21S have diameters slightly larger than that of the developing roller 21BS, and therefore, a small gap or play is provided between the developing roller 21BS and the photosensitive drum 15.

The black developing device 21B, as shown in FIG. 7, is provided exposed at a side surface of the rear side holder 21BR with contacts 21BU1, 21BU2 for applying a bias voltage from the main assembly 80 and for detecting the toner remaining amount. The contact 21BU1 is a developing bias contact. The developing bias contact 21BU1 is contacted to a main assembly developing bias contact pin 62*a* (FIG. 14) which will be described hereinafter, which is provided in the main assembly 80, when the black developing device 21B is mounted to the main assembly 80. It receives the developing bias to be applied to the developing roller 21BS from the main assembly 80. The contact 21BU2 is a remaining amount detecting contact. When the black developing device 21B is mounted to the main assembly 80, and the developing bias is applied to the developing roller 21BS through the developing bias contact 21BU1, the remaining amount detecting contact 21BU2 transmits an electric signal to be supplied to a detecting means (unshown) provided in the main assembly 80. The value of the electric signal is discriminated by the detecting means (unshown) through the main assembly toner remaining amount detecting pin 62*b* (FIG. 14) which will be described hereinafter, so that main assembly 80 can detect that toner remaining amount in the toner accommodating portion 21BK is smaller than a predetermined amount. When the main assembly 80 detects that toner remaining amount in the toner accommodating portion 21BK is smaller than a first predetermined amount, the main assembly 80 notifies the user of the necessity of exchange of the black developing device 21B (for example, flickering of a lamp) (level 1). Thereafter, when the main assembly 80 detects that toner remaining amount in the toner accommodating portion 21BK is smaller than a second predetermined amount, the main assembly 80 of the apparatus is stopped (level 2).

The electric signal is produced in accordance with the electrostatic capacity between a developing roller 21BS and an antenna (unshown).

On the other hand, the main assembly contact pins 62*a*, 62*b* are provided at the rear side of the main assembly 80. The contacts 21BU1, 21BU2 of the black developing device 21B and the main assembly contact pins 62*a*, 62*b* are contacted to each other, so that electrical connection is established therebetween.

As shown in FIGS. 12 and 13, the orientation of the rotation lever 51 is vertical, and caps a part of the insertion opening 63 for the black developing device. Therefore, even if the user attempts to pull the black developing device 21B out, it abuts the rotation lever 51 and is not taken out.

Accordingly, when the user pulls the black developing device 21B out of the main assembly, the rotation lever 51 has to be rotated to a horizontal position. Only in such a state, the black developing device 21B can be mounted to or demounted from the main assembly.

(Removal of the black developing device)

When the black developing device 21B is to be removed from the main assembly 80 of the apparatus, the rotation lever 51 is rotated to a horizontal position (FIG. 3). By pulling the black developing device 21B, it can be removed out. In this embodiment, the front side holder 21BF of the black developing device 21B is provided with an integrally formed grip portion 21BX which can be hooked by fingers, as shown in FIG. 12. Therefore, the user can smoothly pulls the black developing device 21B out using the grip portion 21BX.

Immediately before the black developing device 21B is pulled out of the main assembly 80, the elongated hole 21BY formed in the front side holder 21BF is engaged with the swing shaft 54. That is, the black developing device 21B is supported by the swing shaft 54 at the front side. Therefore, when the elongated hole 21BY is disengaged from the swing shaft 54, the black developing device 21B lowers by the weight thereof, so that black developing device 21B is supported by the swingable guide 50A.

In this embodiment, the engagement length between the swing shaft 54 and the elongated hole 21BY is long enough. More particularly, as shown in FIG. 9, when the black developing device 21B is mounted, and the is disposed at the rear side beyond the end surface B of the opening of the insertion opening 63, the engagement length L between the swing shaft 54 (supporting portion of the main assembly 80) and the elongated hole 21BY (front side pivot of the developing device 21B) is longer than the distance L1 between the wall surface C of the developing device 21B which is closest to the end surface B of the opening and the end surface B of the opening. By doing so, when the elongated hole 21BY is disengaged from the swing shaft 54, the wall surface C of the black developing device is prevented from abutting the member defining the opening of the insertion opening 63.

Referring to FIGS. 16, 17 and 18, other embodiments will be described.

FIG. 16 is a side view of a leading side of the black developing device with respect to the mounting direction of the black developing device (mounted in the main assembly); FIG. 17 is a side view of a trailing side of the black developing device (mounted in the main assembly); and FIG. 18 is a side view of the black developing device located at the developing position.

In this embodiment, the angle of the longitudinal direction of the elongated hole 21BY (line L2) is within approx. 5°–15° relative to the line L3 connecting the center of the female coupling recess 21B9 and the center of the hole 21BD. Preferably, the above-described angle is 5° approx.

According to this embodiment, when the black developing cartridge 21B is mounted to the development position of the main assembly 80, the longitudinal direction (direction indicated by the arrow L2 in FIG. 18) of the elongated hole 21BY is substantially codirectional with the direction in which the developing roller 21BS is urged toward the peripheral surface of the photosensitive drum 15 (direction indicated by the arrow L4 in FIG. 18) (as shown in FIG. 18, lines L2, L4 are substantially parallel).

Therefore, even if there is an assembling error in the image forming apparatus P, an error in the parts thereof, an assembling error in the black developing cartridge 21B or an error in the part thereof, the black developing cartridge 21B is correctly positioned to the developing position within the range of the elongated hole 21BY, since the developing roller 21BS is movable toward and away from the peripheral surface of the photosensitive drum 15 (directions indicated by the arrow Y in FIG. 18).

In FIG. 18, designated by 73 is a portion where a grip (unshown) for pulling the toner seal (unshown) has been provided.

The positioning of the black developing cartridge 21B in the foregoing embodiment is summarized as follows:

1. The developing cartridge (21B) for developing a latent image formed on a photosensitive member (15), which is detachably mountable relative to a main assembly (80) of an electrophotographic image forming apparatus, comprises:

a developing member (e.g. 21BS) for developing a latent image formed on the photosensitive member;

a toner accommodating portion (e.g. 21BK) for accommodating toner to be used for developing the latent image formed on the photosensitive member by said developing member;

a first recess (e.g. 21BD) for engagement with a first positioning member provided in the main assembly, said first recess being provided at a leading side end portion (holder 21BR side) of said developing cartridge when it is mounted to the main assembly in a longitudinal direction of said developing member;

a second recess (e.g. 21BR1) for engagement with a second positioning member provided in the main assembly, said second recess being provided at the leading side end portion of said developing cartridge when it is mounted to the main assembly in the longitudinal direction of said developing member;

a driving force receiving member (21BG), provided in said second recess, for receiving driving force for rotating said developing member from the main assembly;

a third recess (21BY) for engagement with a third positioning member provided in the main assembly, said third recess being provided at a trailing side end portion (e.g. holder 21BF side) of said developing cartridge when it is mounted to the main assembly in the longitudinal direction of said developing member, wherein said third recess is provided in a free end portion of an arm (e.g. 21BF1) projected in a direction crossing with the longitudinal direction of said developing member.

2. Said first recess (e.g. 21BD) has an elongated hole configuration.

3. Said second recess (21BR1) has a circular configuration.

4. Said third recess (21BY) has an elongated hole configuration.

5. An angle between a longitudinal direction of the elongated hole configuration of said third recess (e.g. 21BY) and a line connecting centers of said first recess (e.g. 21BD) and said second recess (e.g. 21BR1) is approx. 5.0°–15.0°.

6. The cartridge further comprises a first guide portion (e.g. 21BC1) and a second guide portion (e.g. 21BC2), extended in the longitudinal direction of said developing member, for guiding said developing cartridge when said developing cartridge is mounted to the main assembly in the longitudinal direction of said developing member.

7. The longitudinal direction of the elongated hole configuration of said first recess (21BD) is directed substantially toward said second recess (e.g. 21BR1).

8. A diameter of said second recess (e.g. 21BR1) is larger than a length, measured in the longitudinal direction of the elongated hole configuration, of said first recess (21BD).

9. The length of said first recess (e.g. 21BD) is not less than approx. 9.0 mm, and a width thereof is approx. 7.0 mm–9.0 mm, and a diameter of said second recess (e.g. 21BR1) is approx. 8.0 mm–10.0 mm.

10. The length of said third recess (e.g. 21BY) is approx. 8.0 mm–10.0 mm, and the width thereof is approx. 7.0 mm–9.0 mm.

11. The main assembly (e.g. 80) includes a swingable supporting member (e.g. 50) for supporting said developing cartridge (e.g. 21B), said swingable supporting member being swingable about an axis (e.g. 54, 55) between a developing position for placing said developing cartridge at an operating position and a retracted position retracted from the operating position, wherein said first positioning member (e.g. 50K) and said second positioning member (e.g. 50L) are provided on said swingable supporting member at a rear side of said swingable supporting member, and wherein said third positioning member (e.g. 54) is disposed on an extension of the axis.

12. Said first recess (e.g. 21BD) is disposed adjacent one longitudinal end of said developing member in a direction crossing with the longitudinal direction of said developing member, and said second recess (21BR1) is disposed at one longitudinal end of said toner accommodating portion (e.g. 21BK).

13. The developing cartridge further comprises an exposed developing bias contact (e.g. 21BU1), at said one end of said developing cartridge, for receiving, from the main assembly, a developing bias voltage to be supplied to said developing member when said developing cartridge is mounted to the main assembly.

14. The developing cartridge further comprises an exposed toner remaining amount detecting contact (e.g. 21BU2), at said one end of said developing cartridge, for permitting the main assembly to detects a toner remaining amount in said toner accommodating portion, said remaining amount detecting contact being juxtaposed with said developing bias contact (e.g. 21BU1).

15. The developing cartridge further comprises a shutter (e.g. 21BO) movable between a covering position for covering a surface of said developing member and an exposing position, retracted from said covering position, for exposing a surface of said developing member, and wherein a first center (e.g. 21BP2) of rotation of a first supporting arm (e.g. 21BP) for supporting one longitudinal end of said shutter and a second center (e.g. 21BQ1) of rotation of second supporting arm (e.g. 21BQ) for supporting the other longitudinal end of said shutter are provided at said one longitudinal end of said developing cartridge.

The drive transmission for the black developing cartridge 21B in the foregoing embodiment is summarized as follows:

1. A developing cartridge (e.g. 21B) for developing a latent image formed on the photosensitive member (e.g. 15), which is detachably mountable to a main assembly (e.g. 80) of an electrophotographic image forming apparatus, comprises:

a developing member (e.g. 21BS) for developing a latent image formed on the photosensitive member;

a toner accommodating portion (e.g. 21BK) for accommodating toner to be used for developing a latent image formed on said photosensitive member by said developing member;

a driving force receiving portion (e.g. 21BG) for receiving, from the main assembly, driving force for rotating said developing member when said developing cartridge is mounted to the main assembly, said driving force receiving portion being provided at a leading side (e.g. 21BR side) of said developing cartridge when said developing cartridge is mounted to the main assembly in a longitudinal direction of said developing member;

an exposed developing bias contact (e.g. 21BU1), provided at said leading side, for receiving from the main assembly a developing bias to be supplied to said developing member when said developing cartridge is mounted to the main assembly;

wherein said driving force receiving portion is disposed inside said developing bias contact in the longitudinal direction of the developing member. Since the driving force receiving member is disposed in the recess, it is not easily damaged, so that the rotational accuracy can be maintained.

2. Said driving force receiving portion (e.g. 21BG) is disposed in a hole (e.g. 21BR1) provided in said cartridge frame, and said hole is engaged with a positioning member (e.g. 50L) provided in the main assembly when said developing cartridge is mounted to the main assembly.

3. Said driving force receiving portion is in the form of a circular member (e.g. 21BG) having an axis at a position different from that of an axis of a developing roller (e.g. 21BS) as said developing member, wherein said circular member is engaged with a driving force transmission member (e.g. 50E) provided in the main assembly with axial movement thereof, and by rotation of said driving force transmission member, said circular member is rotated.

4. The driving force received by said circular member (e.g. 21BG) is transmitted to one end of said developing roller (e.g. 21BS) through a gear (e.g. 50F) disposed coaxial with said developing roller.

5. The cartridge further comprises an exposed toner remaining amount detecting contact (e.g. 21BU2), juxtaposed adjacent said developing bias contact (e.g. 21BU1), for permitting the main assembly to detects a remaining amount of toner in said toner accommodating portion.

6. A free end side of said driving force receiving portion (e.g. 21BG) is disposed inside a surface of said developing bias contact (e.g. 21BU1) by approx. 8.0 mm–18.0 mm. By this, when the black developing device is mounted by moving it in its longitudinal direction, the driving force receiving member 21BG and the driving force transmitting member 50E can be engaged after the cartridge is correctly positioned by the positioning member 50L. Additionally, after the positioning, the electric contacts 21BU1 and 21BU2 can be contacted to the main assembly pins 62*a* and 62*b*.

7. The cartridge further comprises a shutter (e.g. 21BO) movable between a covering position for covering a surface of said developing member and an exposing position, retracted from said covering position, for exposing a surface of said developing member, wherein a first center of rotation of a first supporting arm (e.g. 21BP) for supporting one longitudinal end of said shutter and a second center of rotation of second supporting arm (e.g. 21BQ1) for supporting the other longitudinal end of said shutter, are provided at said one longitudinal end of said developing cartridge.

8. The cartridge further comprises a grip (e.g. 21BX) at the other end of said developing cartridge, which is usable when said developing cartridge is mounted to or demounted from the main assembly.

9. The cartridge further comprises a second grip, at the other end of said developing cartridge, for pulling out a toner seal 21B7 (FIG. 11) for unsealably sealing a toner supply opening (e.g. 21BK1) of said toner accommodating portion, and wherein by pulling out the toner seal 21BT (FIG. 11) using said second grip before start of use of said cartridge, said toner supply opening 21BK1 is opened to permit the toner to be supplied to said developing member from said toner accommodating portion.

The foregoing embodiments are directed to a color image forming apparatus as an example, but the present invention is applicable to a monochromatic image forming apparatus. In the foregoing embodiments, the black development cartridge is taken as an example, the present invention is applicable to a color development cartridge.

In the foregoing embodiments, the printer is taken as an example, but the present invention is applicable to a copying machine, facsimile machine or another electrophotographic recording system image forming apparatus.

According to the present invention, the developing device can be properly mounted or demounted by inserting or pulling it along the swingable guide portion of the image forming apparatus. Therefore, in a color image forming apparatus, the black developing device which can accommodate a large amount of toner can be easily mounted or demounted.

With the swing axis of the swingable guide portion parallel with the generating line of the electrophotographic photosensitive member, the parallelism between the developing roller of the developing device and the electrophotographic photosensitive member is easily assured so that developing device and the main assembly of the image forming apparatus can be correctly positioned, and therefore, high quality images can be produced.

As described in the foregoing, according to the present invention, the positioning of the developing cartridge relative to the main assembly of the electrophotographic image forming apparatus can be improved.

While the invention has been described with reference to the structures disclosed herein, it is not confined to the details set forth and this application is intended to cover such modifications or changes as may come within the purposes of the improvements or the scope of the following claims.

What is claimed is:

1. A developing cartridge for developing a latent image formed on an electrophotographic photosensitive member, which is detachably mountable to a main assembly of an electrophotographic image forming apparatus, said developing cartridge comprising:

a cartridge frame;

a developing member for developing a latent image formed on the photosensitive member;

a toner accommodating portion for accommodating toner to be used for developing a latent image formed on said photosensitive member by said developing member;

a driving force receiving portion for receiving, from the main assembly, a driving force for rotating said developing member when said developing cartridge is mounted to the main assembly, said driving force receiving portion being provided at a leading side of said developing cartridge when said developing cartridge is mounted to the main assembly in a longitudinal direction of said developing member, wherein said driving force receiving portion is provided in a recess in said cartridge frame;

a developing bias contact exposed outwardly through said cartridge frame and provided at said leading side, for receiving from the main assembly a developing bias to be supplied to said developing member when said developing cartridge is mounted to the main assembly;

wherein said driving force receiving portion is disposed inside said developing bias contact in the longitudinal direction of the developing member.

2. A developing cartridge according to claim 1, wherein a wall constituting the recess is engaged with a positioning member provided in the main assembly to correctly position said developing cartridge when said developing cartridge is mounted to the main assembly.

3. A developing cartridge according to claim 1 or 2, wherein said driving force receiving portion is in the form of a circular member having an axis at a position different from that of an axis of a developing roller as said developing member, and by rotation of a said driving force transmission member, said circular member is rotated.

4. A developing cartridge according to claim 3, wherein the driving force received by said circular member is transmitted to one end of said developing roller through a gear disposed coaxial with said developing roller.

5. A developing cartridge according to claim 3, wherein a free end side of said driving force receiving portion is disposed inside a surface of said developing bias contact by approx. 8.0 mm–18.0 mm.

6. A developing cartridge according to claim 1 or 2, further comprising a toner remaining amount detecting contact exposed through said cartridge frame and juxtaposed adjacent said developing bias contact, for permitting the main assembly to detect a remaining amount of toner in said toner accommodating portion.

7. A developing cartridge according to claim 1, further comprising a shutter movable between a covering position for covering a surface of a developing roller as said developing member which surface is otherwise exposed through said cartridge frame and an exposing position, retracted from said covering position, for exposing a surface of said developing roller, wherein a first center of rotation of a first supporting arm for supporting one longitudinal end of said shutter and a second center of rotation of a second supporting arm for supporting one longitudinal end of said shutter, are provided at a longitudinal end of said developing member.

8. A developing cartridge according to claim 1, further comprising a grip at one longitudinal end of said developing member, which is usable when said developing cartridge is mounted to or unmounted from the main assembly.

9. A developing cartridge according to claim 1 or 8, further comprising a second grip, at the other longitudinal end of said developing member, for pulling out a toner seal for unsealably sealing a toner supply opening of said toner accommodating portion, and wherein by pulling out the toner seal using said second grip before start of use of said cartridge, said toner supply opening is opened to permit the toner to be supplied to said developing member from said toner accommodating portion.

10. A developing cartridge according to claim 1, wherein the main assembly includes a swingable supporting member for supporting said developing cartridge, said swingable supporting member being swingable about an axis between a developing position for placing said developing cartridge at an operating position for development and a retracted position where said developing cartridge is retracted from said operating position, and wherein said developing cartridge is detachably mounted relative to said swingable supporting member.

11. A developing cartridge for developing a latent image formed on an electrophotographic photosensitive drum, which is detachably mountable relative to a main assembly of an electrophotographic image forming apparatus provided with a driving force transmission member, said developing cartridge comprising:

a cartridge frame;

a developing roller for developing a latent image formed on the photosensitive drum;

a toner accommodating portion for accommodating toner to be used for developing the latent image formed on the photosensitive drum by said developing roller;

a driving force receiving portion for receiving, from the main assembly, a driving force for rotating said developing roller when said developing cartridge is mounted to the main assembly, said driving force receiving portion being provided at a leading side of said developing cartridge when said developing cartridge is mounted to the main assembly in a longitudinal direction of said developing roller, wherein said driving force receiving portion is disposed in a recess provided in said cartridge frame, and a wall constituting a recess is engaged with a positioning member provided in the main assembly when said developing cartridge is mounted to the main assembly, wherein said driving force receiving portion is in the form of a circular member having an axis at a position different from that of an axis of said developing roller, and by rotation of a driving force transmission member, said circular member is rotated, and wherein the driving force received by said circular member is transmitted to one end of said developing roller through a gear disposed coaxial with said developing roller;

a developing bias contact exposed outwardly through said cartridge frame and provided at said leading side, for receiving from the main assembly a developing bias to be supplied to said developing roller when said developing cartridge is mounted to the main assembly;

a toner remaining amount detecting contact exposed outwardly through said cartridge frame and juxtaposed adjacent said developing bias contact, for permitting the main assembly to detect a remaining amount of toner in said toner accommodating portion;

wherein said driving force receiving portion is disposed inside said developing bias contact in the longitudinal direction of the developing roller.

12. A developing cartridge according to claim 11, wherein a free end side of said driving force receiving portion is disposed inside a surface of said developing bias contact by 8.0 mm–18.0 mm.

13. A developing cartridge according to claim 11, further comprising a shutter movable between a covering position for covering a surface of said developing roller which surface is otherwise exposed through said cartridge frame and an exposing position, retracted from said covering position, for exposing a surface of said developing roller, wherein a first center of rotation of a first supporting arm for supporting one longitudinal end of said shutter and a second center of rotation of second supporting arm for supporting one longitudinal end of said shutter, are provided at a longitudinal end of said developing roller.

14. A developing cartridge according to claim 11, further comprising a grip at one longitudinal end of said developing roller, which is usable when said developing cartridge is mounted to or unmounted from the main assembly.

15. A developing cartridge according to claim 14, further comprising a second grip, at the other longitudinal end of said developing roller, for pulling out a toner seal for unsealably sealing a toner supply opening of said toner accommodating portion, and wherein by pulling out the toner seal using said second grip before start of use of said cartridge, said toner supply opening is opened to permit the toner to be supplied to said developing roller from said toner accommodating portion.

16. A developing cartridge according to claim 11, wherein the main assembly includes a swingable supporting member for supporting said developing cartridge, said swingable supporting member being swingable about an axis between a developing position for placing said developing cartridge at an operating position for development and a retracted position retracted where said developing cartridge is retracted from said operating position, and wherein said developing cartridge is detachably mounted relative to said swingable supporting member.

17. A developing cartridge for developing a latent image formed on an electrophotographic photosensitive drum, which is detachably mountable relative to a main assembly of an electrophotographic image forming apparatus provided with a driving force transmission member, said developing cartridge comprising:

a cartridge frame;

a developing roller for developing a latent image formed on the photosensitive drum;

a toner accommodating portion for accommodating toner to be used for developing the latent image formed on the photosensitive drum by said developing roller;

a driving force receiving portion for receiving, from the main assembly, a driving force for rotating said developing roller when said developing cartridge is mounted to the main assembly, said driving force receiving portion being provided at a leading side of said developing cartridge when said developing cartridge is mounted to the main assembly in a longitudinal direction of said developing roller, wherein said driving force receiving portion is disposed in a recess provided in said cartridge frame, and a wall constituting said recess is engaged with a positioning member provided in the main assembly when said developing cartridge is mounted to the main assembly, wherein said driving force receiving portion is in the form of a circular member having an axis at a position different from that of an axis of a developing roller, and by rotation of a driving force transmission member, said circular member is rotated, and wherein the driving force received by said circular member is transmitted to one end of said developing roller through a gear disposed coaxial with said developing roller;

a developing bias contact exposed through said cartridge frame and provided at said leading side, for receiving from the main assembly a developing bias to be supplied to said developing roller when said developing cartridge is mounted to the main assembly;

a toner remaining amount detecting contact exposed through said cartridge frame and juxtaposed adjacent said developing bias contact, for permitting the main assembly to detect a remaining amount of toner in said toner accommodating portion;

a shutter movable between a covering position for covering a surface of said developing roller, which surface is otherwise exposed through said cartridge frame, and an exposing position, retracted from said covering position, for exposing a surface of said developing roller, wherein a first center of rotation of a first supporting arm for supporting one longitudinal end of said shutter and a second center of rotation of second supporting arm for supporting one longitudinal end of said shutter, are provided at one longitudinal end of said developing cartridge;

a grip at the other longitudinal end of said developing cartridge, which is usable when said developing cartridge is mounted to or demounted from the main assembly;

a second grip, at the other longitudinal end of said developing cartridge, for pulling out a toner seal for unsealably sealing a toner supply opening of said toner accommodating portion, and wherein by pulling out the toner seal using said second grip before start of use of said cartridge, said toner supply opening is opened to permit the toner to be supplied to said developing roller from said toner accommodating portion;

wherein a free end side of said driving force receiving portion is disposed inside a surface of said developing bias contact by 8.0 mm–18.0 mm.

18. An electrophotographic image forming apparatus for forming an image on a recording material, to which a developing cartridge is detachably mountable, comprising:

a. a driving force transmission member for transmitting a driving force;

b. a feeding member for feeding the recording material;

c. a mounting member for detachably mounting said developing cartridge, which includes:

a cartridge frame;

a developing member for developing a latent image formed on a photosensitive member;

a toner accommodating portion for accommodating toner to be used for developing a latent image formed on said photosensitive member by said developing member;

a driving force receiving portion for receiving, from the main assembly, a driving force for rotating said developing member when said developing cartridge is mounted to the main assembly, said driving force receiving portion being provided at a leading side of said developing cartridge when said developing cartridge is mounted to the main assembly in a longitudinal direction of said developing member, wherein said driving force receiving portion is provided in a recess formed in said cartridge frame;

a developing bias contact exposed outwardly through said cartridge frame and provided at said leading side, for receiving from the main assembly a developing bias to be supplied to said developing cartridge is mounted to the main assembly;

wherein said driving force receiving portion is disposed inside said developing bias contact in the longitudinal direction of the developing member.

19. An electrophotographic image forming apparatus for forming an image on a recording material, to which a developing cartridge is detachably mountable, comprising:

a. a driving force transmission member for transmitting driving force;

b. a feeding member for feeding the recording material;

c. a mounting member for detachably mounting a developing cartridge;

said developing cartridge including:

a cartridge frame;

a developing roller for developing a latent image formed on a photosensitive drum;

a toner accommodating portion for accommodating toner to be used for developing the latent image formed on the photosensitive drum by asid developing roller;

a driving force receiving portion for receiving, from the main assembly, a driving force for rotating said developing roller when said developing cartridge is mounted to the main assembly, said driving force receiving portion being provided at a leading side of said developing cartridge when said developing cartridge is mounted to the main assembly in a longitudinal direction of said developing roller, wherein said driving force receiving portion is disposed in a recess provided in said cartridge frame, and a wall constituting a recess is engaged with a positioning member provided in the main assembly when said developing cartridge is mounted to the main assembly, wherein said driving force receiving portion is in the form of a circular member having an axis at a position different from that of an axis of said developing roller, and by rotation of said driving force transmission member, said circular member is rotated, and wherein the driving force received by said circular member is transmitted to one end of said developing roller through a gear disposed coaxial with said developing roller;

a developing bias contact exposed outwardly through said cartridge frame and provided at said leading side, for receiving from the main assembly a developing bias to be supplied to said developing roller when said developing cartridge is mounted to the main assembly;

a toner remaining amount detecting contact exposed outwardly through asid cartridge frame and juxtaposed adjacent said developing bias contact, for permitting the main assembly to detects a remaining amount of toner in said toner accommodating portion;

wherein said driving force receiving portion is disposed inside said developing bias contact in the longitudinal direction of the developing roller.

20. An electrophotographic image forming apparatus for forming an image on a recording material, to which a developing cartridge is detachably mountable, comprising:

a. a driving force transmission member for transmitting driving force;

b. a feeding member for feeding the recording material;

c. a mounting member for detachably mounting a developing cartridge;

said developing cartridge including:

a cartridge frame;

a developing roller for developing a latent image formed on a photosensitive drum;

a toner accommodating portion for accommodating toner to be used for developing the latent image formed on the photosensitive drum by said developing roller;

a driving force receiving portion for receiving, from the main assembly, a driving force for rotating said developing roller when said developing cartridge is mounted to the main assembly, said driving force receiving portion being provided at a leading side of said developing cartridge when said developing cartridge is mounted to the main assembly in a longitudinal direction of said developing roller, wherein said driving force receiving portion is disposed in a recess provided in said cartridge frame, and a wall constituting a recess is engaged with a positioning member provided in the main assembly when said developing cartridge is mounted to the main assembly, wherein said driving force receiving portion is in the form of a circular member having an axis at a position different from that of an axis of a developing roller, and by rotation of said driving force transmission member, said circular member is rotated, and wherein the driving force received by said circular member is transmitted to one end of said developing roller through a gear disposed coaxial with said developing roller;

a developing bias contact exposed outwardly through said cartridge frame and provided at said leading side, for receiving from the main assembly a developing bias to be supplied to said developing roller when said developing cartridge is mounted to the main assembly;

a toner remaining amount detecting contact exposed outwardly through asid cartridge frame and juxtaposed adjacent said developing bias contact, for permitting the main assembly to detects a remaining amount of toner in said toner accommodating portion;

a shutter movable between a covering position for covering a surface of said developing roller, which surface is otherwise exposed through said cartridge frame, and an exposing position, retracted from said covering position, for exposing a surface of said developing roller, wherein a first center of rotation of a first supporting arm for supporting one longitudinal end of said shutter and a second center of rotation of a second supporting arm for supporting said one longitudinal end of said shutter, are provided at one longitudinal end of said developing cartridge;

a grip at the other longitudinal end of said developing cartridge, which is usable when said developing cartridge is mounted to or unmounted from the main assembly;

a second grip, at the other longitudinal end of said developing cartridge, for pulling out a toner seal for unsealably sealing a toner supply opening of said toner accommodating portion, and wherein by pulling out the toner seal using said second grip before start of use of said cartridge, said toner supply opening is opened to permit the toner to be supplied to said developing roller from said toner accommodating portion;

wherein a free end side of said driving force receiving portion is disposed inside a surface of said developing bias contact by 8.0 mm–18.0 mm.

* * * * *

UNITED STATES PATENT AND TRADEMARK OFFICE

CERTIFICATE OF CORRECTION

PATENT NO. : 5,923,926

DATED : July 13, 1999

INVENTOR(S) : HIRONOBU ISOBE, ET AL.

It is certified that error appears in the above-identified patent and that said Letters Patent is hereby corrected as shown below:

COLUMN 4,
Line 40, "is" should be deleted.

COLUMN 5,
Line 17, "upper" should read --the photosensitive drum 15--; and
Line 47, "accumulation" should be --accumulated--.

COLUMN 7,
Line 15, "a" should be deleted.

COLUMN 8,
Line 22, "rotation," should read --rotated--.

COLUMN 10,
Line 34, "21BI" should read --21B1--.

COLUMN 11,
Line 28, "functions" should read --functions as--.

COLUMN 15,
Line 14, "detects" should read --detect--.

COLUMN 16,
Line 42, "21B7" should read --21BT--.

COLUMN 17,
Line 56, "said" should be deleted;
Line 61, "coaxial" should read --coaxially--; and
Line 65, "approx." should be deleted.

UNITED STATES PATENT AND TRADEMARK OFFICE

CERTIFICATE OF CORRECTION

PATENT NO. : 5,923,926

DATED : July 13, 1999

INVENTOR(S) : HIRONOBU ISOBE, ET AL.

It is certified that error appears in the above-identified patent and that said Letters Patent is hereby corrected as shown below:

COLUMN 18,
Line 21, "1 or" should be deleted.

COLUMN 19,
Line 5, "coaxial" should read --coaxially--.

COLUMN 21,
Line 20, "cartridge" should read --cartridge,--;
Line 41, "asid" should read --said--; and
Line 65, "coaxial" should read --coaxially--.

COLUMN 22,
Line 5, "asid" should read –said–; and
Line 7, "detects" should read –detect–.

Signed and Sealed this

Seventh Day of November, 2000

*Attest:*

Q. TODD DICKINSON

*Attesting Officer*

*Director of Patents and Trademarks*